US007890004B2

(12) United States Patent
Fujii et al.

(10) Patent No.: US 7,890,004 B2
(45) Date of Patent: Feb. 15, 2011

(54) IMAGE FORMING APPARATUS, POST-PROCESSING APPARATUS, AND IMAGE FORMING CONTROL METHOD AND PROGRAM FOR IMPLEMENTING THE METHOD

(75) Inventors: Takayuki Fujii, Tokyo (JP); Mitsushige Murata, Yokohama (JP); Toshiyuki Miyake, Toride (JP)

(73) Assignee: Canon Kabushiki Kaisha (JP)

( * ) Notice: Subject to any disclaimer, the term of this patent is extended or adjusted under 35 U.S.C. 154(b) by 447 days.

(21) Appl. No.: 11/375,358

(22) Filed: Mar. 14, 2006

(65) Prior Publication Data

US 2006/0216048 A1 Sep. 28, 2006

(30) Foreign Application Priority Data

Mar. 14, 2005 (JP) ..... 2005-071899

(51) Int. Cl.
*G03G 15/00* (2006.01)

(52) U.S. Cl. ..... 399/45

(58) Field of Classification Search ..... 399/45
See application file for complete search history.

(56) References Cited

U.S. PATENT DOCUMENTS 4,393,375 A * 7/1983 Sugiura et al. ..... 399/81
7,172,187 B2 * 2/2007 Terao et al. ..... 399/410 X

FOREIGN PATENT DOCUMENTS

| | | | |
|---|---|---|---|
| JP | 7-112834 A | | 5/1995 |
| JP | 08169628 A | * | 7/1996 |
| JP | 8-305210 A | | 11/1996 |
| JP | 2004-085982 A | | 3/2004 |

OTHER PUBLICATIONS

JPO Machine Translation of Otomo (JP 08-169628 A), Published Jul. 2, 1996.*

* cited by examiner

*Primary Examiner*—David M Gray
*Assistant Examiner*—Erika Villaluna
(74) *Attorney, Agent, or Firm*—Rossi, Kimms & McDowell LLP

(57) ABSTRACT

An image forming apparatus that enables a post-processing apparatus to perform optimum control in accordance with the type (thickness) of sheet. A user sets on an image forming apparatus main unit 10 a thickness of sheet to be conveyed. A CPU circuit section 150 obtains first thickness-determination information used for the sheet conveying speed control in a finisher 500 from the finisher 500. A plurality of candidate sheet thicknesses that can be set, are determined based on the first thickness-determination information obtained by the CPU circuit section 150 and second thickness-determination information used when image-forming process speed control is performed in the image forming apparatus main unit 10 according to sheet thickness.

10 Claims, 23 Drawing Sheets

*FIG. 2*

| SHEET TYPE | THICKNESS (BASIS WEIGHT IN GRAMS) | IMAGE FORMING PROCESS SPEED |
|---|---|---|
| ORDINARY SHEET | 64～100g/$m^2$ | 300mm/s |
| THICK SHEET | 101～250g/$m^2$ | 150mm/s |
| | 251g/$m^2$～ | 100mm/s |

*FIG. 12*

| SHEET TYPE | THICKNESS (BASIS WEIGHT IN GRAMS) | CONVEYING SPEED IN FINISHER |
|---|---|---|
| ORDINARY SHEET | ~200g/$m^2$ | 500mm/s |
| THICK SHEET | 201g/$m^2$~ | 350mm/s |

*FIG. 21*

| | FINISHER ID | | |
|---|---|---|---|
| | FINISHER A | FINISHER B | FINISHER C |
| SHEET THICKNESS THRESHOLD INFORMATION | 250g/m$^2$ | 200g/m$^2$ | 200g/m$^2$ |
| | — | 280g/m$^2$ | — |

IMAGE FORMING APPARATUS, POST-PROCESSING APPARATUS, AND IMAGE FORMING CONTROL METHOD AND PROGRAM FOR IMPLEMENTING THE METHOD

BACKGROUND OF THE INVENTION

1. Field of the Invention

The present invention relates to an image forming apparatus, a post-processing apparatus, and an image forming control method and a program for implementing the method, and more particularly, to an image forming apparatus to which a post-processing apparatus can be attached that controls the sheet conveying speed in accordance with sheet thickness, a post-processing apparatus attached to the image forming apparatus, an image forming control method applied to the image forming apparatus, and a program for causing a computer to perform the image forming control method.

2. Description of the Related Art

Conventionally, image forming apparatuses such as copiers include sheet-type setting means provided in a sheet supply cassette for receiving recording sheets (for example see Japanese Laid-Open Patent Publication (Kokai) No. H07-112834) or setting keys provided on an operation unit for entering sheet types (for example see Japanese Laid-Open Patent Publication (Kokai) No. H08-305210), so that the type of sheets loaded in a sheet supply cassette may be set. There has also been known to carry out control in accordance with the set sheet type to prevent special sheets from being fed unnecessarily, change the speed at which recording sheets are fed from a sheet supply cassette, or change the fixing speed during image formation.

For a post-processing apparatus, attached to an image forming apparatus, for performing a process of sorting sheet bundles and a process of stapling each sorted sheet bundle, there is a demand that the apparatus be capable of performing such processes to any types of sheets discharged from the image forming apparatus. On the other hand, types of sheets handled by image forming apparatuses are increasing, and the capability of image formation on thicker sheets is especially demanded.

For size reduction of a post-processing apparatus, it is effective to bend a conveying path in the apparatus, however, the load applied on a driving system when a sheet is conveyed along the bent conveying path is much greater for a thick sheet than an ordinary sheet. Therefore, in a post-processing apparatus having a bent conveying path, control must be made for causing the driving system to change the torque in accordance with sheet thickness.

However, there is a problem that the optimum torque control cannot be achieved in the post-processing apparatus because the type (thickness) of sheet, which is setting information for each individual sheet feed cassette in the conventional image forming apparatuses, is effective in controlling the image forming apparatus but not necessarily effective in controlling the post-processing apparatus.

SUMMARY OF THE INVENTION

It is an object of the present invention to provide an image forming apparatus that enables a post-processing apparatus to perform optimum control in accordance with the type (thickness) of sheet, a post-processing apparatus for use in such an image forming apparatus, and an image forming control method, and a program for the implementing the method.

To attain the above object, in a first aspect of the present invention, there is provided an image forming apparatus adapted for being connected with a post-processing apparatus that carries out sheet conveying speed control according to sheet thickness, comprising a setting device that permits a user to set on the image forming apparatus a thickness of sheet to be conveyed, an obtaining device that obtains first thickness-determination information used for the sheet conveying speed control in the post-processing apparatus from the post-processing apparatus, and a determining device that determines a plurality of candidate sheet thicknesses that can be set by the setting device, based on the first thickness-determination information obtained by the obtaining device and second thickness-determination information used when image-forming process speed control is performed in the image forming apparatus according to sheet thickness.

Preferably, the image forming apparatus comprises a communication device that communicates with the post-processing apparatus, wherein the obtaining device obtains the first thickness-determination information from the post-processing apparatus via the communication device upon power being turned on.

Preferably, each piece of the first and second thickness-determination information represents one of an upper and lower limits of a corresponding one of a plurality of sheet thickness ranges that can be set by the setting device.

Preferably, the image forming apparatus comprises a display device that displays the plurality of candidate sheet thicknesses determined by the determining device, wherein the setting device inputs a sheet thickness selected by a user from among the plurality of candidate sheet thicknesses displayed by the display device into the image forming apparatus.

To attain the above object, in a second aspect of the present invention, there is provided an image forming apparatus adapted for being connected with one of a plurality of post-processing apparatuses that carry out sheet conveying speed control according to sheet thickness, comprising a storing device that stores pieces of first thickness-determination information used for the sheet conveying speed control in the plurality of post-processing apparatuses in a storage apparatus in association with pieces of identification information indicating the post-processing apparatuses, a setting device that permits a user to set on the image forming apparatus a thickness of sheet to be conveyed, an obtaining device that obtains identification information indicating one of the post-processing apparatuses which is connected to the image forming apparatus from the connected post-processing apparatus, a reading device that reads out the first thickness-determination information associated with the identification information obtained by the obtaining device from among the pieces of the first thickness-determination information stored in the storage apparatus, and a determining device that determines a plurality of candidate sheet thicknesses that can be set by the setting device, based on the first thickness-determination information read out by the reading device and second thickness-determination information used when image-forming process speed control is performed in the image forming apparatus according to sheet thickness.

To attain the above object, in a third aspect of the present invention, there is provided an image forming apparatus adapted for being connected with a post-processing apparatus that carries out sheet conveying speed control according to sheet thickness, comprising an obtaining device that obtains first thickness-determination information used for the sheet conveying speed control in the post-processing apparatus from the post-processing apparatus, and a determining device that determines a plurality of candidate sheet thicknesses used for carrying out control of operations of the image forming apparatus and the post-processing apparatus according to sheet thickness, based on the first thickness-determination information obtained by the obtaining device and second thickness-determination information used when image-forming process speed control is performed in the image forming apparatus according to sheet thickness.

To attain the above object, in a fourth aspect of the present invention, there is provided a post-processing apparatus adapted to be connected to an image forming apparatus, comprising an obtaining device that obtains information about a thickness of sheet conveyed from the image forming apparatus, and a control device that carries out sheet conveying speed control in the post-processing apparatus according to the information obtained by the obtaining device.

To attain the above object, in a fifth aspect of the present invention, there is provided an image forming control method for an image forming apparatus adapted for being connected with a post-processing apparatus that carries out sheet conveying speed control according to sheet thickness and having a setting device that permits a user to set on the image forming apparatus a thickness of sheet to be conveyed, the method comprising the steps of obtaining first thickness-determination information used for the sheet conveying speed control in the post-processing apparatus from the post-processing apparatus, and determining a plurality of candidate sheet thicknesses that can be set by the setting device, based on the first thickness-determination information obtained in the obtaining step and second thickness-determination information used when image-forming process speed control is performed in the image forming apparatus according to sheet thickness.

To attain the above object, in a sixth aspect of the present invention, there is provided an image forming control method for an image forming apparatus adapted for being connected with one of a plurality of post-processing apparatuses that carry out sheet conveying speed control according to sheet thickness and having a setting device that permits a user to set on the image forming apparatus a thickness of sheet to be conveyed, the method comprising the steps of obtaining identification information indicating one of the post-processing apparatuses which is connected to the image forming apparatus from the connected post-processing apparatus, reading out first thickness-determination information associated with the identification information obtained in the obtaining step from a storage apparatus, in which pieces of the first thickness-determination information used for the sheet conveying speed control in the plurality of post-processing apparatuses are stored in association with pieces of the identification information indicating the post-processing apparatuses, and determining a plurality of candidate sheet thicknesses that can be set by the setting device, based on the first thickness-determination information read out in the reading step and second thickness-determination information used when image-forming process speed control is performed in the image forming apparatus according to sheet thickness.

To attain the above object, in a seventh aspect of the present invention, there is provided a computer-readable program for causing a computer to perform an image forming control method for an image forming apparatus adapted for being connected with a post-processing apparatus that carries out sheet conveying speed control according to sheet thickness and having a setting device that permits a user to set on the image forming apparatus a thickness of sheet to be conveyed, the method comprising the steps of obtaining first thickness-determination information used for the sheet conveying speed control in the post-processing apparatus from the post-processing apparatus, and determining a plurality of candidate sheet thicknesses that can be set by the setting device, based on the first thickness-determination information obtained in the obtaining step and second thickness-determination information used when image-forming process speed control is performed in the image forming apparatus according to sheet thickness.

To attain the above object, in an eighth aspect of the present invention, there is provided a computer-readable program for causing a computer to perform an image forming control method for an image forming apparatus adapted for being connected with one of a plurality of post-processing apparatuses that carry out sheet conveying speed control according to sheet thickness and having a setting device that permits a user to set on the image forming apparatus a thickness of sheet to be conveyed, the method comprising the steps of obtaining identification information indicating one of the post-processing apparatuses which is connected to the image forming apparatus from the connected post-processing apparatus, reading out first thickness-determination information associated with the identification information obtained in the obtaining step from a storage apparatus, in which pieces of the first thickness-determination information used for the sheet conveying speed control in the plurality of post-processing apparatuses are stored in association with pieces of the identification information indicating the post-processing apparatuses, and determining a plurality of candidate sheet thicknesses that can be set by the setting device, based on the first thickness-determination information read out in the reading step and second thickness-determination information used when image-forming process speed control is performed in the image forming apparatus according to sheet thickness.

With the present invention, an image forming apparatus that carries out sheet conveying speed control according to sheet thickness, includes setting device that permit a user to set on the image forming apparatus a thickness of sheet to be fed. First thickness-determination information used for the sheet conveying speed control in the post-processing apparatus is obtained from the post-processing apparatus, and a plurality of candidate sheet thicknesses that can be set by the setting device are determined based on the first thickness-determination information obtained by the obtaining device and second thickness-determination information used when image-forming process speed control is performed in the image forming apparatus according to sheet thickness.

This ensures that information required for the post-processing apparatus to control the sheet conveying speed in accordance with the sheet thickness is reliably set by a user, so that the post-processing apparatus can perform optimum control according to the sheet thickness.

Furthermore, when the type of sheets in a sheet supply cassette is set, a plurality of candidate sheet thicknesses that can be set by using the setting device are determined on the basis of information required for the post-processing apparatus to perform sheet conveying speed control according to sheet thickness in addition to information required for the image forming apparatus to carry out image-forming process speed control according to sheet thickness. Therefore, it is unnecessary for the user to carry out operations for individually entering these pieces of information, so that the user is free from performing troublesome operations.

The above and other objects, features, and advantages of the invention will become more apparent from the following detailed description taken in conjunction with the accompanying drawings.

BRIEF DESCRIPTION OF THE DRAWINGS

FIG. 2 is a diagram showing the relationship between sheet thickness and process speed according to the embodiment;

FIG. 12 is a diagram showing the relationship between sheet thickness and sheet conveying speed in the finisher;

FIG. 21 is a diagram showing a sheet thickness threshold information table containing sheet thickness thresholds for a plurality of finishers and stored in a ROM in the CPU circuit section of the controller;

DETAILED DESCRIPTION OF THE PREFERRED EMBODIMENTS

The present invention will now be described in detail below with reference to the drawings showing preferred embodiments thereof.

Figure 1:
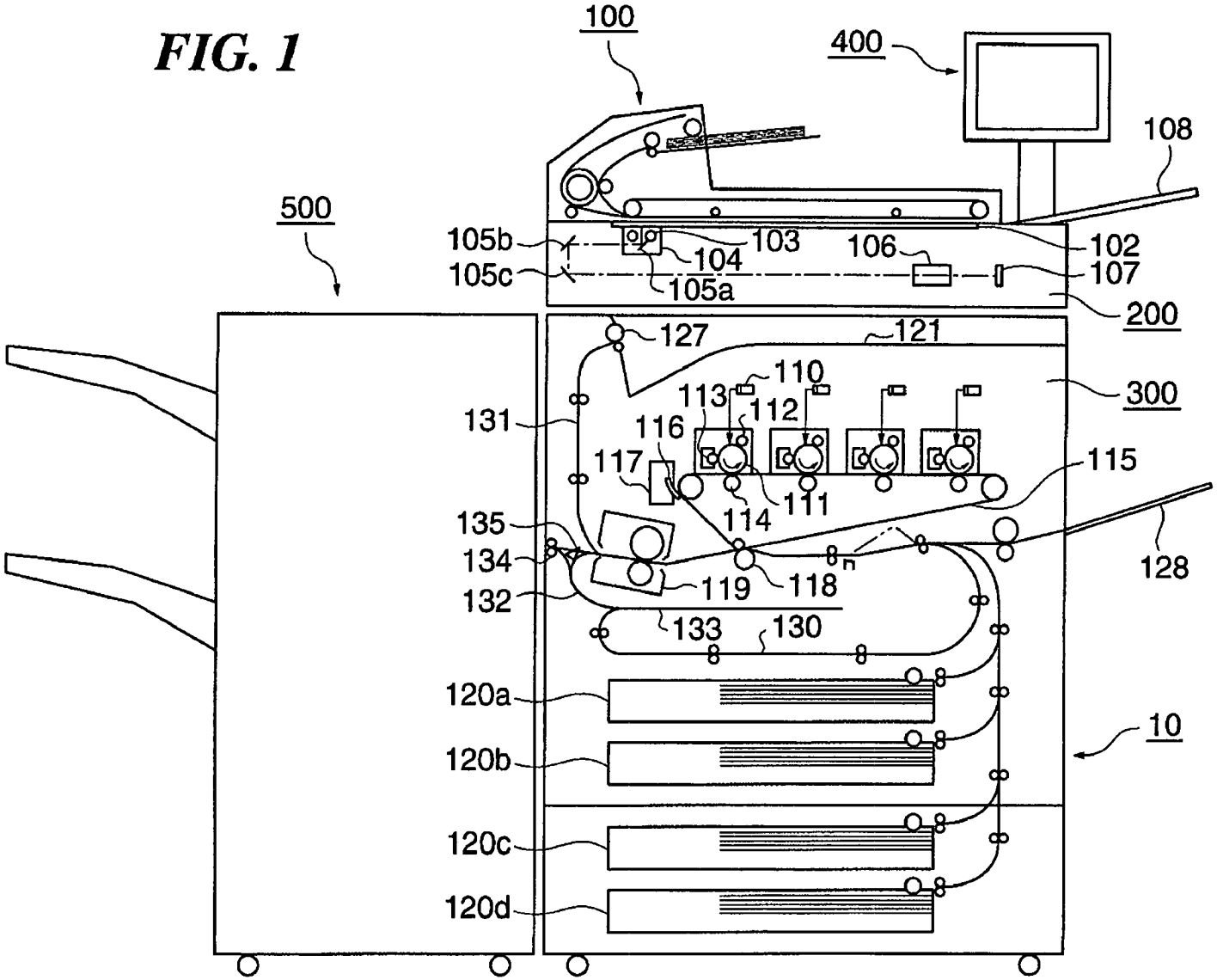
FIG. 1 is a longitudinal cross-sectional view showing the construction of principal parts of an image forming system including an image apparatus according to an embodiment of the present invention.

FIG. 1 is a longitudinal cross-sectional view showing the construction of principal parts of the image forming system including an image forming apparatus according to an embodiment of the present invention.

The image forming system is comprised of an image forming apparatus main unit 10 and a finisher 500. The image forming apparatus main unit 10 includes an image reader 200 that reads an image of an original and a color printer 300.

An original feeding device 100 is mounted on the image reader 200. The original feeding device 100 feeds originals set face up on an original tray leftward as viewed in FIG. 1, one sheet at a time starting from a top page. Each original is conveyed via a curved path onto a platen glass 102 from the left and then conveyed to the right. After this, the original is discharged to an external discharge tray 108. When each original passes an original-through reading position on the platen glass 102 from the left to the right, an image of the original is read by a scanner unit 104 held at a position corresponding to the original-through reading position. This reading method is generally referred to as an "original-through reading method". More specifically, when an original passes the original-through reading position, light from the lamp 103 of the scanner unit 104 is irradiated onto a reading surface of the original. Light reflected from the original is guided via mirrors 105*a*, 105*b*, and 105*c* to a lens 106. The light that has passed through the lens 106 forms an image on an image pickup plane of an image sensor 107.

In this way, by conveying an original from left to right at the original-through reading position, the original is scanned (read), with a direction perpendicular to the conveying direction of the original as the main scanning direction and the conveying direction as the sub-scanning direction. That is, when the original passes the original-through reading position, one line of the image of the original is read in the main scanning direction by the image sensor 107 and then the original is conveyed in the sub-scanning direction, thereby reading the entire original image. The optically read image is converted by the image sensor 107 into image data and output. The image data output from the image sensor 107 is subjected to predetermined processing by an image signal controller 202, described later, and is input as a video signal to an exposure controller 110 of the printer 300.

Note that it is also possible to read the original by conveying the original with the original feeding device 100 onto the platen glass 102, stopping the original at a predetermined position, and scanning the original by causing the scanner unit 104 to move from left to right with the original in this state. This scanning method is called a "stationary original reading method".

When reading an original without using the original feeding device 100, first the user lifts up the original feeding device 100 and places the original on the platen glass 102.

After this, the scanner unit 104 is caused to scan the original from left to right to read the original. That is, when the original is read without using the original feeding device 100, the stationary original reading method is executed.

The exposure controller 110 of the color printer 300 modulates laser light based on the input video signal and the modulated laser light is incident on a photosensitive drum 111 charged by a charger 112. An electrostatic latent image is formed on the photosensitive drum 111 in accordance with the incident laser light.

The electrostatic latent image on the photosensitive drum 111 is developed as a developer image using a developer (toner) supplied by a developing device 113. The developer image is then transferred by a primary transfer roller 114 onto an intermediate transfer belt 115. The developer image is transferred onto the intermediate transfer belt 115 in four steps for four colors, yellow, cyan, magenta, and black, in this order from the upstream, each delayed by an amount of conveyance time.

A sheet fed from a cassette 120*a*, 120*b*, 120*c*, 120*d*, a manual feed section 128, or a double-sided conveying path 130 is conveyed to a nip between the intermediate transfer belt 115 and a secondary transfer roller 118 and the four-color developer image on the intermediate transfer belt 115 is transferred to the sheet.

The sheet onto which the developer image has been transferred is conveyed to a fixing section 119 and the fixing section 119 fixes the developer image onto the sheet by applying heat and pressure to the sheet. When the sheet that has passed the fixing section 119 is discharged to a discharge tray 121 of the printer 300, the sheet is guided to a discharge path 131 by a flapper 135 and conveyed toward a discharge roller 127.

When the sheet is discharged to the finisher 500, this can be done in either of the following two ways. When the sheet is discharged in a state where the surface on which the image has been formed faces down, the sheet is guided by the flapper 135 from the fixing section 119 to an invert path 132, where the conveying direction is changed, and the sheet is discharged by a discharge roller 134 from the printer 300 to the finisher 500. This way of discharge is hereinafter referred to as inverted discharge. Inverted discharge is performed when first-page-first image forming is performed such as when an image is formed based on image data read using the original feeding device 100 or when an image is formed based on image data output from a computer, so that the discharged sheets are stacked in the correct order.

When an image is formed on a special sheet such as an OHP sheet fed from the manual feed section 128, the sheet is discharged to the finisher 500 through the discharge roller 134 in a state where the surface on which the image has been formed faces up without the sheet being guided to the invert path 132.

When double-sided recording is set for forming images on both sides of a sheet, the sheet is guided to the invert path 132 by switching the flapper 135, and is then conveyed to the double-sided conveying path 130, and is rerouted back to the position between the intermediate transfer belt 115 and the secondary transfer roller 118.

The sheet discharged from the printer 300 to the finisher 500 is subjected to predetermined processing such as stapling process.

A cleaner blade 116 and a waste toner box 117 are disposed at a location downstream of the intermediate transfer belt 115 as a cleaning device for cleaning the image forming surface.

In the present embodiment, when an ordinary sheet (weighing up to 100 g/m$^2$) is used, the operating speed of the photosensitive drum 111, the intermediate transfer belt 115, the secondary transfer roller 118, and the fixing section 119 (hereinafter referred to as the process speed) is set to 300 mm/s. The amount of heat generated per unit time while the fixing section 119 is heating a sheet is set to a predetermined value according to sheet size irrespective of sheet thickness. Accordingly, a thick sheet absorbs more heat than an ordinary sheet and the roller surface temperature of the fixing section 119 does not reach the required temperature. Therefore, if a thick sheet is processed at the same process speed as that for ordinary sheet, developer will not be properly fixed. In the present embodiment, therefore the process speed is changed according to sheet thickness. Specifically, the process speed for thick sheets (101-250 g/m$^2$) is set to 150 mm/s and that for thicker sheets (251 g/m$^2$ or more) is set to 100 mm/s. FIG. 2 is a diagram showing the relationship between sheet thickness and process speed according to the present embodiment.

Next, the construction of a controller that controls the image forming system will be described with reference to FIG. 3.

Figure 3:
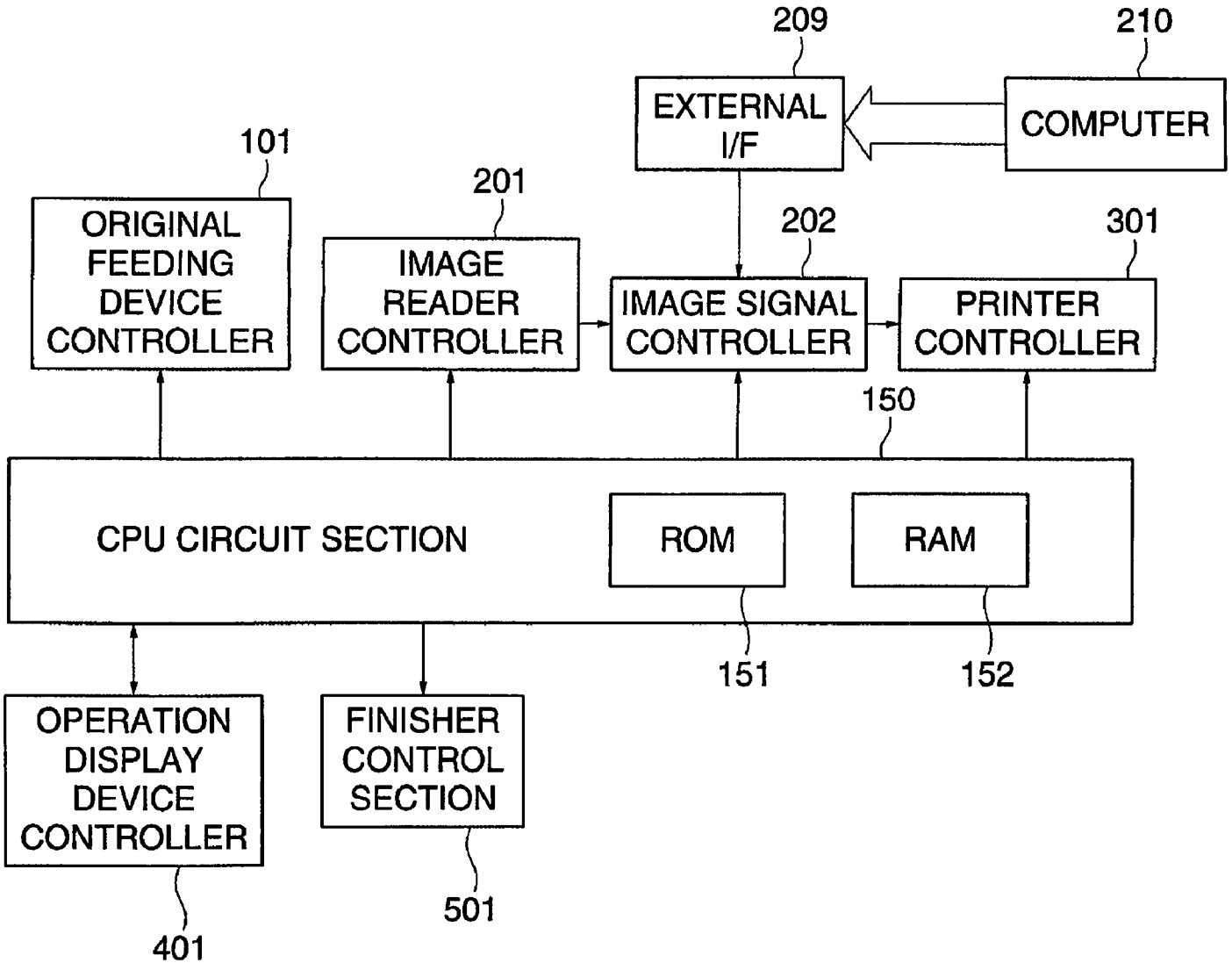
FIG. 3 is a block diagram showing the construction of a controller that controls the image forming system shown in FIG. 1.

FIG. 3 is a block diagram showing the construction of the controller that controls the image forming system shown in FIG. 1.

The controller includes a CPU circuit section 150 in which a CPU (not shown), a ROM 151, and a RAM 152 are incorporated, and collectively controls respective blocks 101, 201, 202, 209, 301, 401, and 501 by executing control programs stored in the ROM 151. The RAM 152 temporarily stores control data and is used as a work area for computational processing that accompanies control operations.

An original feeding device controller 101 performs drive control of the original feeding device 100 based on instructions from the CPU circuit section 150. An image reader controller 201 performs drive control of the scanner unit 104, the image sensor 107, and others, and transfers an analog image signal output from the image sensor 107 to the image signal controller 202.

The image signal controller 202 converts the analog image signal from the image sensor 107 to a digital signal, then executes various kinds of image processing thereon, converts the digital signal to a video signal, and outputs the video signal to a printer controller 301. The image signal controller 202 also executes various kinds of image processing on a digital signal input from a computer 210 via an external I/F 209, converts the digital signal to a video signal, and outputs the video signal to the printer controller 301. Processing operations by the image signal controller 202 are controlled by the CPU circuit section 150. The printer controller 301 drives the exposure controller 110 based on the input video signal.

An operation display device controller 401 controls information exchange between an operation display device 400 and the CPU circuit section 150. The operation display device 400 has a plurality of keys for setting various kinds of function relating to image forming and a display section for displaying information indicating the status of settings. The operation display device 400 outputs key signals corresponding to respective operations of the plurality of keys to the CPU circuit section 150, and displays corresponding information based on signals from the CPU circuit section 150 on the display section.

Figure 4:
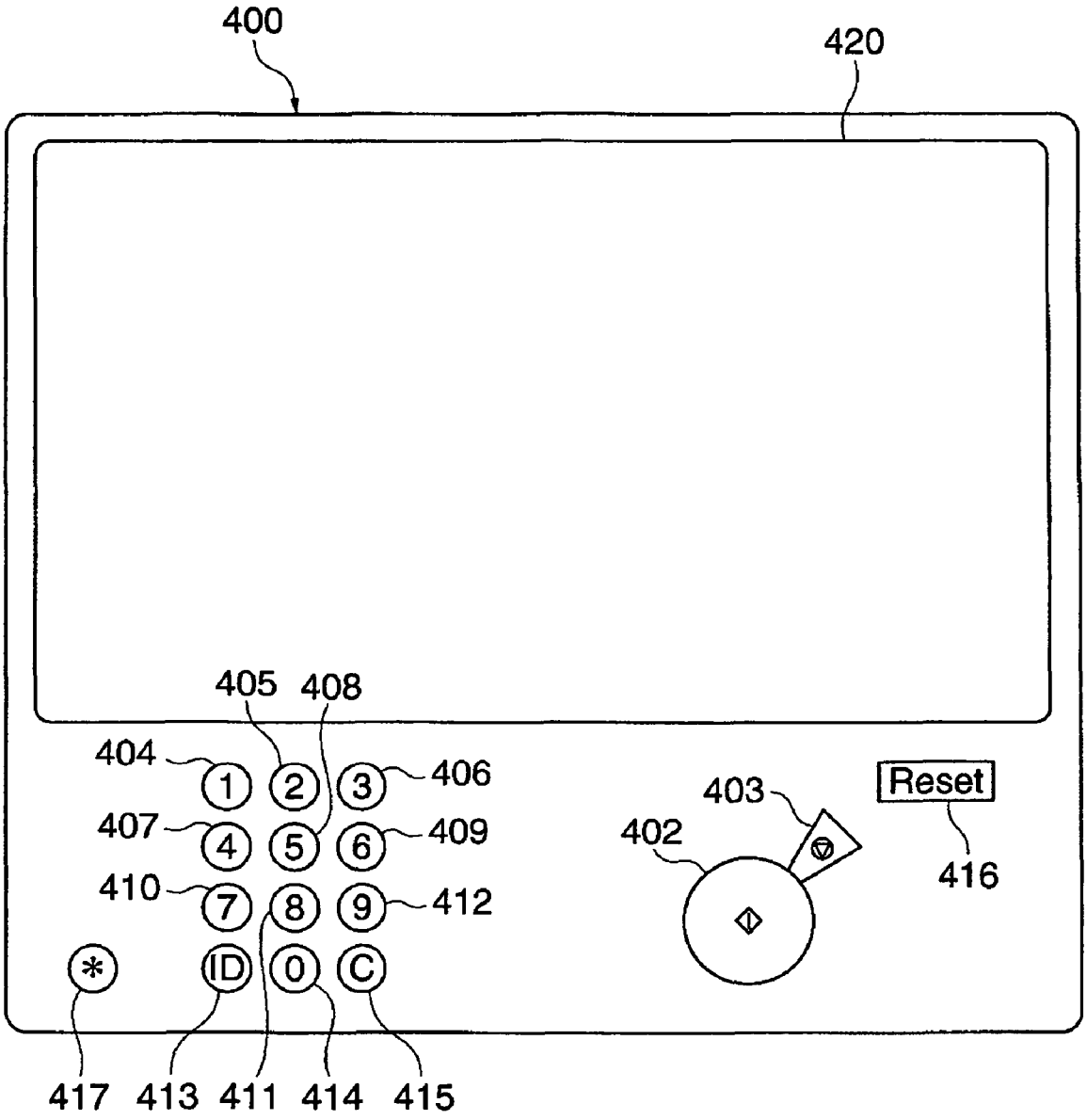
FIG. 4 is a view showing the front face layout of an operation display device in the image forming system shown in FIG. 1.

FIG. 4 is a view showing the front face layout of the operation display device 400 in the image forming system shown in FIG. 1.

The operation display device 400 has a start key 402 for starting an image forming operation, a stop key 403 for interrupting the image forming operation, a ten key 404 to 412 and 414 for numeric settings, an ID key 413, a clear key 415, a reset key 416, a user-mode key 417 for setting various kinds of device, and other keys. In addition, a liquid-crystal display section 420, an upper part of which is composed of a touch panel, is disposed with it being possible to display soft keys on a screen of the liquid crystal display section 420.

Figure 5:
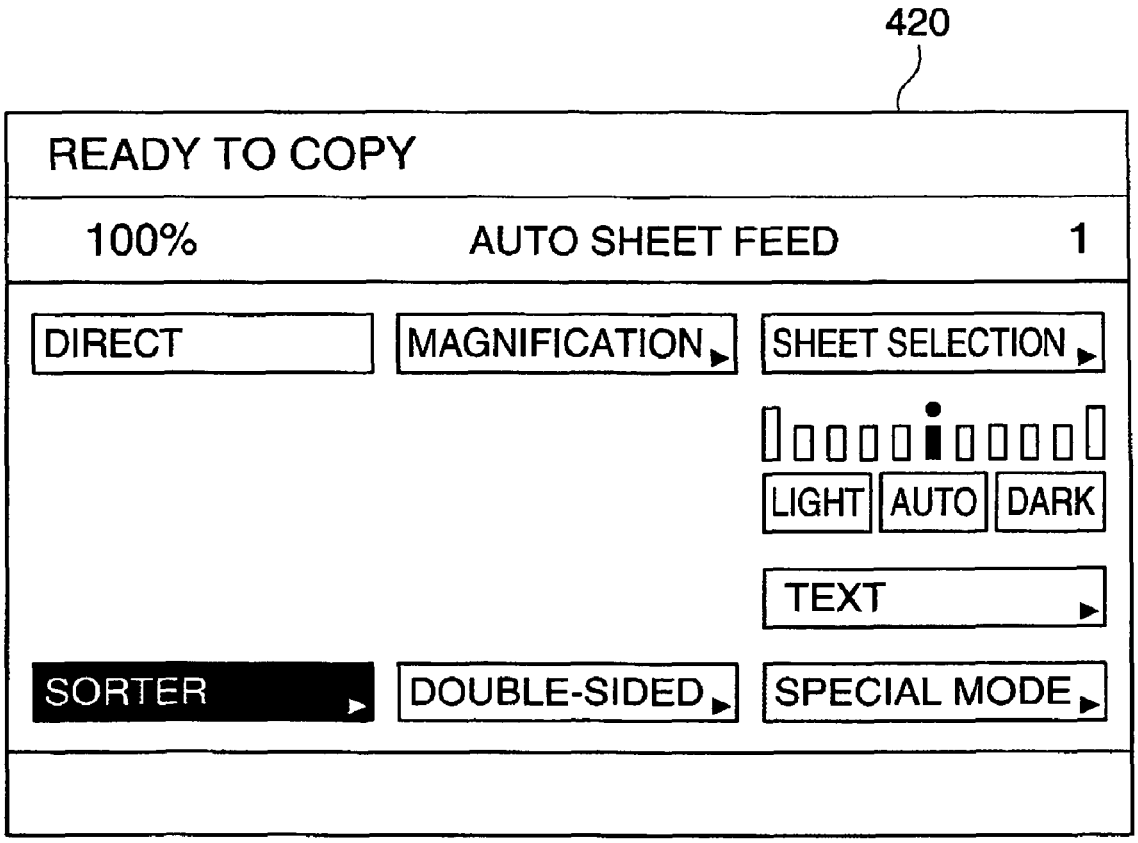
FIG. 5 is a view showing an initial screen displayed on the display of the operation display device.
Figure 6:
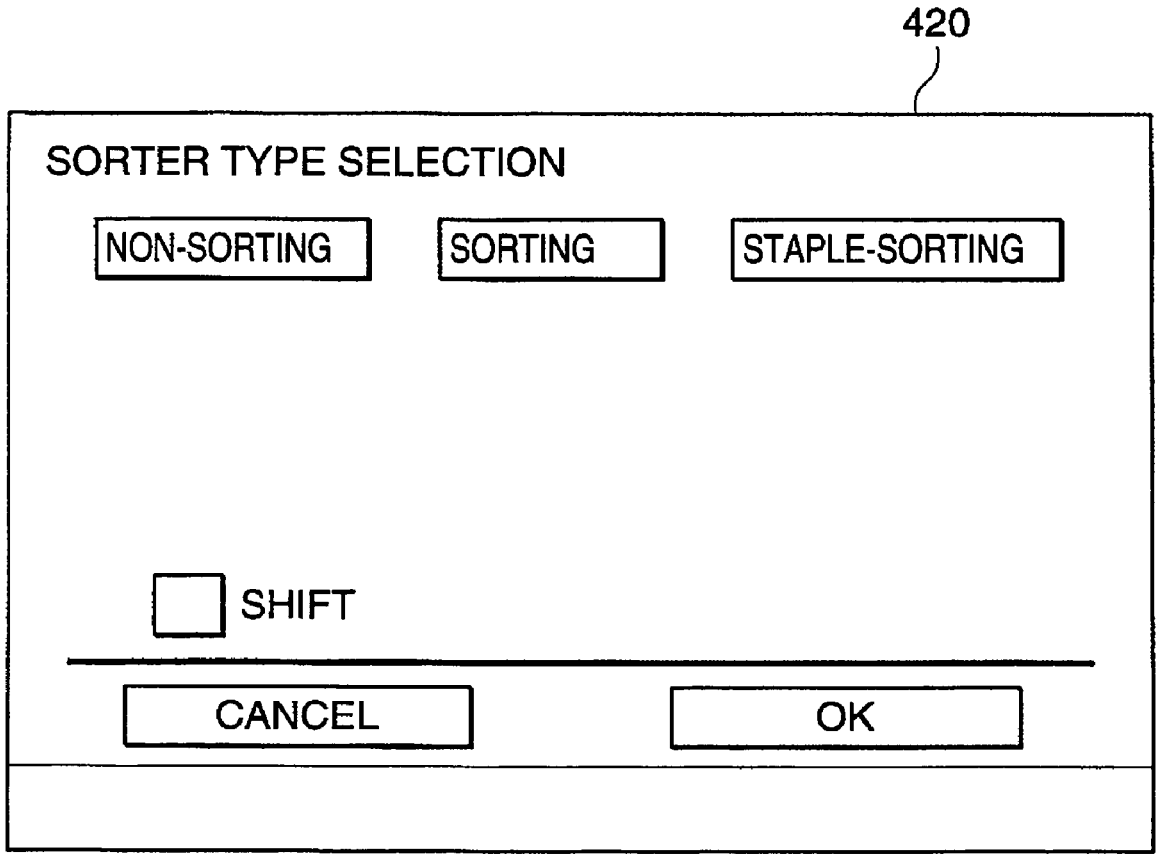
FIG. 6 is a view showing a menu selection screen displayed on the display of the operation display device.

The present image forming system has modes such as a non-sorting (group) mode, a sorting mode, and a staple-sorting mode (stapling mode) as post-processing modes. The setting of such processing modes is performed by an input operation from the operation display device 400. For example, when setting a post-processing mode, if a "SORTER" key, which is a softkey, is selected in an initial screen displayed on the display section 420 of the operation display device 400 as shown in FIG. 5, a menu selection screen shown in FIG. 6 is displayed on the display 420 and the setting of a processing mode is performed using the menu selection screen. FIG. 5 is a view showing the initial screen displayed on the display 420 of the operation display device 400. FIG. 6 is a view showing a menu selection screen displayed on the display 420 of the operation display device 400.

A construction of the finisher 500 will be described with reference to FIG. 7.

Figure 7:
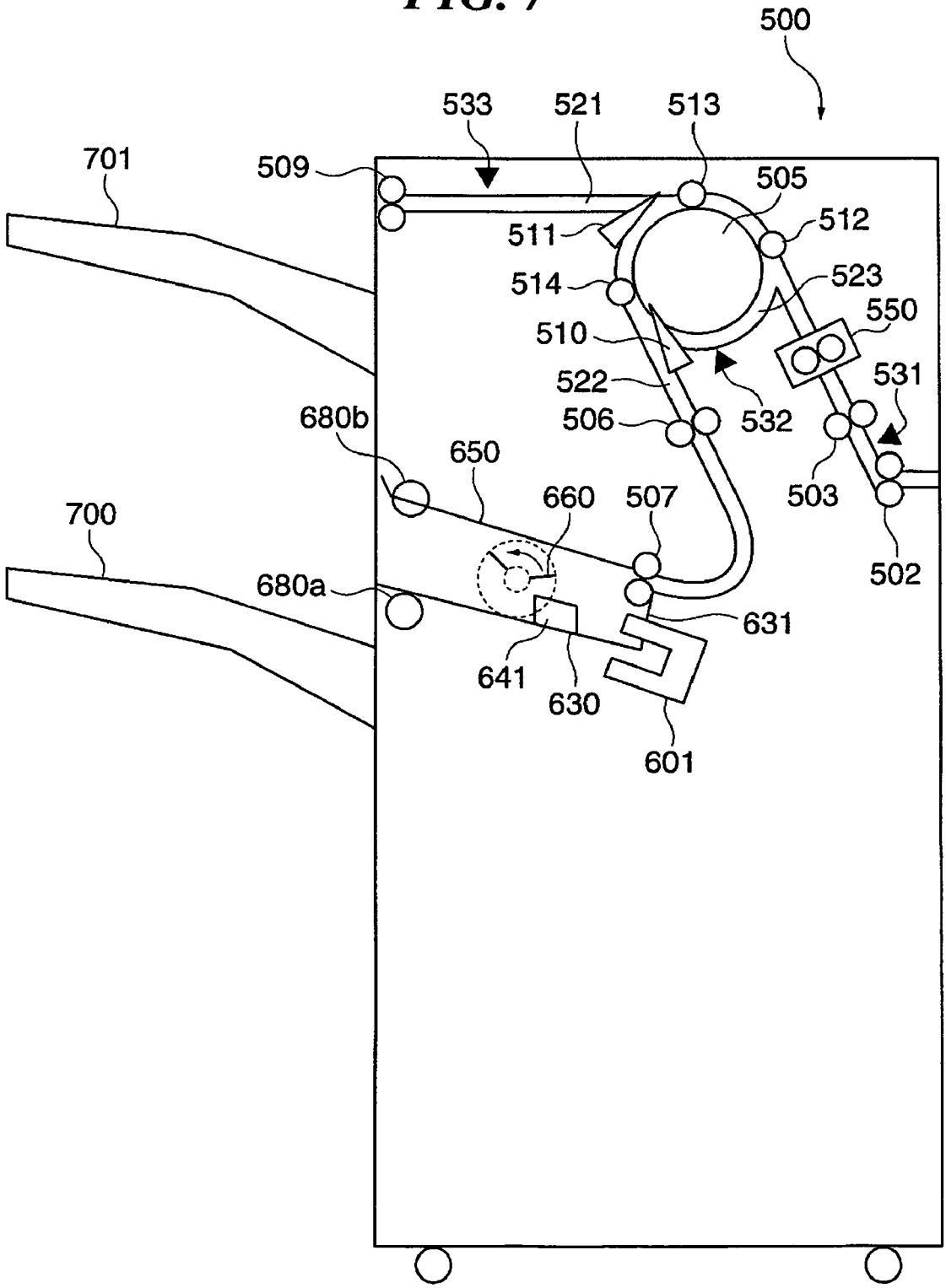
FIG. 7 is a cross-sectional view showing the construction of a finisher in the image forming system shown in FIG. 1.

FIG. 7 is a cross-sectional view showing the construction of the finisher 500 in the image forming system shown in FIG. 1.

The finisher 500 performs various types of post-processing including processing for sequentially taking in sheets discharged from the image forming apparatus main unit 10 and aligning the sheets taken in into a bundle, a stapling process for stapling the trailing end of the sheet bundle by a stapler, a punching process for punching holes in the vicinity of the trailing end of the sheets taken in, a sorting process, and a non-sorting process. Sheets on which images are formed are discharged, via inverse discharge control, in a state where the surface on which the image has been formed faces down, from the image forming apparatus main unit 10 to the finisher 500 in which the post-processing such as the stapling process is applied to the sheets provided in a state where the surface on which the image has been formed faces down.

As shown in FIG. 7, the finisher 500 takes in a sheet discharged from the image forming apparatus main unit 10 by an inlet roller pair 502, and conveys the sheet taken in to a buffer roller 505 via a conveying roller pair 503. An inlet sensor 531 is disposed in a conveying path between the inlet roller pair 502 and the conveying roller pair 503. In a conveying path between the conveying roller pair 503 and the buffer roller 505, there is disposed a punching unit 550 which is operated, as required, to punch holes near the trailing edge of a sheet conveyed thereto.

The buffer roller 505 is capable of winding a predetermined number of sheets conveyed thereto around the outer periphery thereof, and has pressing rollers 512, 513, and 514 provided around the outer periphery thereof, for winding sheets therearound.

A switching flapper 511 is disposed between the pressing rollers 513 and 514, while a switching flapper 510 is disposed at a location downstream of the pressing roller 514. The switching flapper 511 peels off the sheets, which are conveyed by the buffer roller 505 and the pressing roller 513, from the buffer roller 505 and guides the sheets into a non-sorting path 521 or a sorting path 522. The switching flapper 510 peels off the sheets, which are conveyed by the buffer roller 505 and the pressing roller 514, from the buffer roller 505 to guide the sheets into the sorting path 522, or guides the sheets wound around the buffer roller 505 into a buffer path 523.

The sheets guided into the non-sorting path 521 are discharged onto a sample tray 701 via a discharge roller pair 509. In an intermediate portion of the non-sorting path 521, there is disposed a sheet discharge sensor 533.

In an intermediate portion of the buffer path 523, there is disposed a buffer path sensor 532 that detects a sheet on the buffer path 523.

The sheets guided into the sorting path 522 are stacked onto an intermediate tray (hereinafter referred to as the processing tray) 630 via conveying roller pairs 506 and 507. The sheets stacked on the processing tray 630 as a bundle are subjected to the aligning processing, the stapling process, and so forth, as required, followed by being discharged onto a stack tray 700 by discharge rollers 680*a* and 680*b*. The discharge roller 680*b* is supported by a swinging guide 650. The swinging guide 650 is swung by a swinging motor (not shown) to bring the discharge roller 680*b* into contact with a top sheet of a sheet bundle on the processing tray 630. The discharge roller 680*b* in contact with the top sheet on the processing tray 630 cooperates with the discharge roller 680*a* to discharge the sheet bundle on the processing tray 630 toward the stack tray 700.

Figure 9:
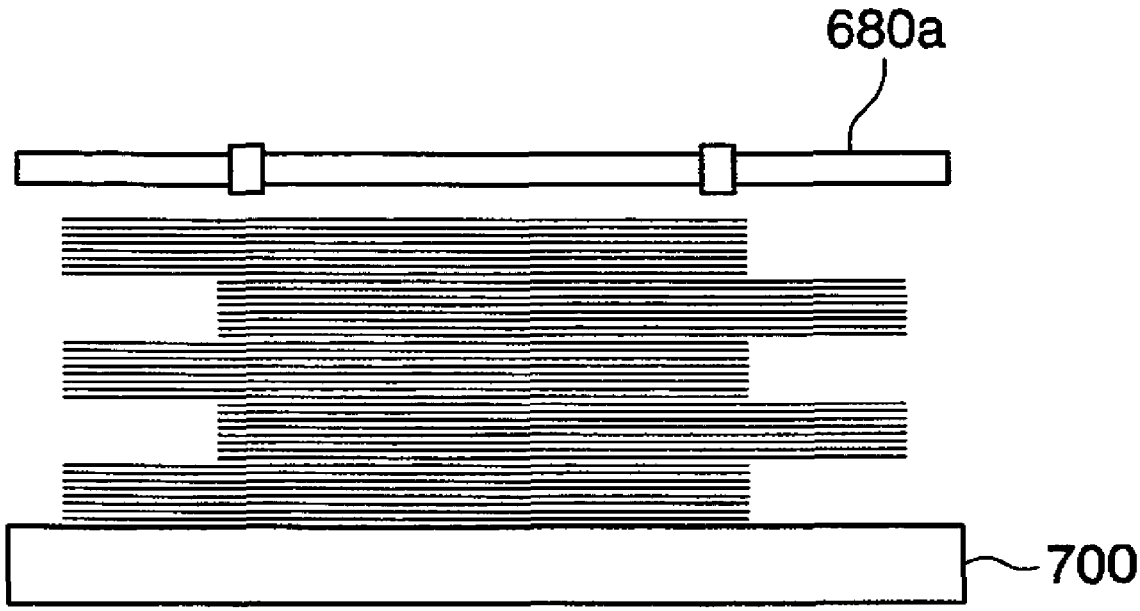
FIG. 9 is a view showing a state in which a plurality of sheet bundles are aligned and stacked on the stack tray, with the aligned sheet bundle positions alternately changed.

In the aligning processing mentioned above, one of aligning plates 641 disposed in the direction perpendicular to the conveying direction of the processing tray 630, that is, on the near and far sides viewed from above FIG. 7, is fixed at a predetermined position and the other is moved back and forth so as to be conformed to the width of the sheet, whereby the sheets are aligned. Then, the aligning operation is performed for changing the alignment position alternately on a sheet bundle-by-sheet bundle basis. As a result, each sheet bundle is stacked on the stack tray 700 in a state where they are alternately offset from each other as shown in FIG. 9. The alternate changes in the alignment position sort the sheet bundles. This is called shift sorting. FIG. 9 is a view showing a state in which a plurality of sheet bundles are aligned and stacked on the stack tray 700, with the aligned sheet bundle positions alternately changed.

The stapling process mentioned above is performed by a stapler 601. The stapler 601 is movably disposed along the perimeter of the processing tray 630 such that the stapler 601 can staple the trailing end of a sheet bundle stacked on the processing tray 630 with respect to the conveying direction (left-side end, as viewed in FIG. 7).

An arrangement of the finisher control section 501 which performs drive control of the finisher 500 will be described with reference to FIG. 8.

Figure 8:
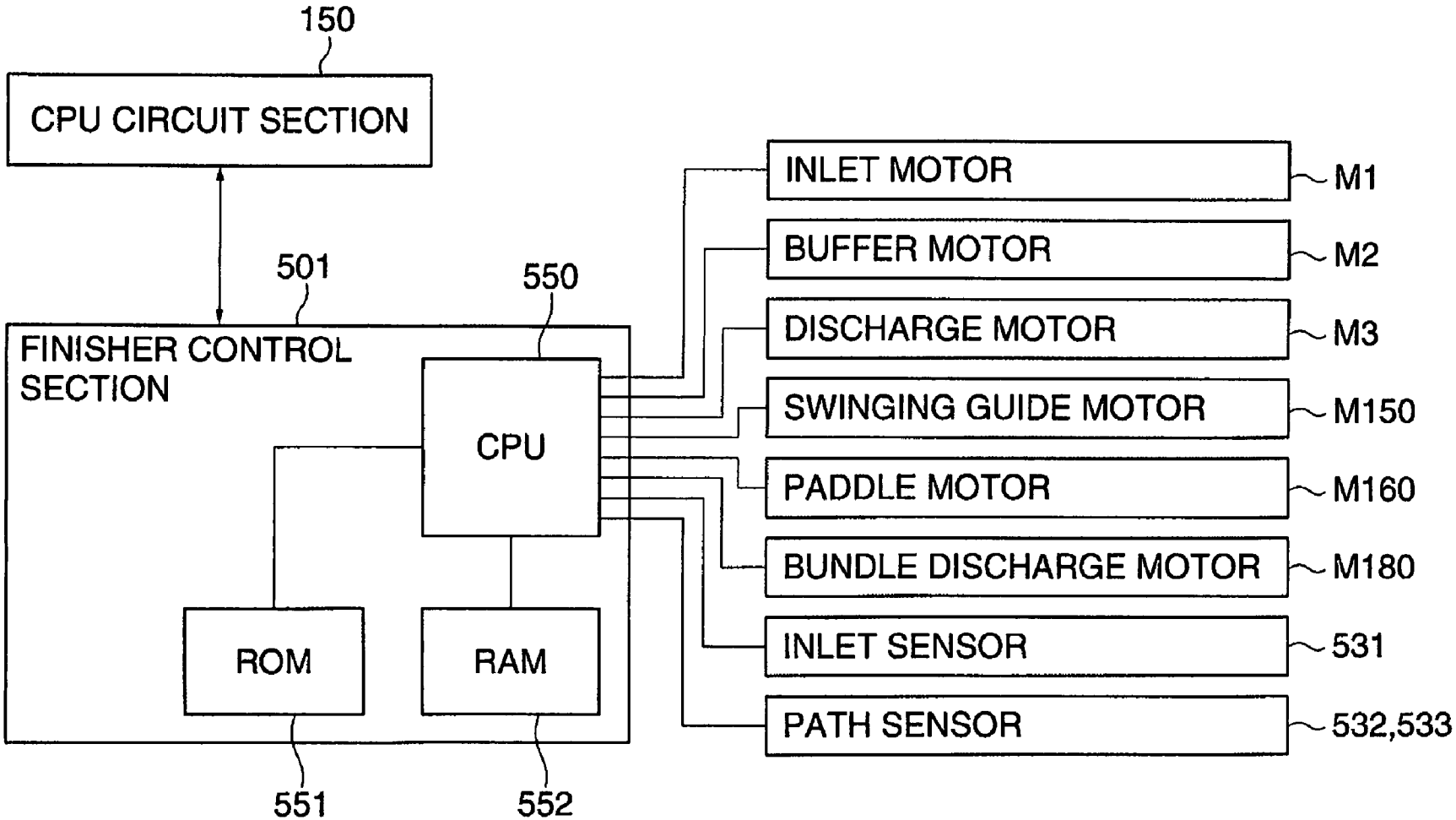
FIG. 8 is a block diagram showing the construction of a finisher control section shown in FIG. 3.

FIG. 8 is a block diagram showing the arrangement of the finisher control section 501 shown in FIG. 3.

The finisher control section 501 includes a CPU 550, a ROM 551, a RAM 552, and other components. The finisher control section 501 communicates with the CPU circuit section 150 provided in the image forming apparatus main unit 10 via a communication IC, not shown, for data exchange, and executes various programs stored in the ROM 551 to control the driving of the finisher 500 according to instructions from the CPU circuit section 150.

Information about post-processing modes, such as non-sorting mode, sorting mode, and staple-sorting, set in the operation display device 400 described above is sent from the CPU circuit section 150 to the finisher control section 501 as communication data.

Loads of the finisher control section 501 that are drivingly controlled by the finisher control section 501 include an inlet motor M1 which drives the inlet roller pair 502 and the conveying roller pair 503, a buffer motor M2 which drives the buffer roller 505, and a sheet discharge motor M3 which drives the conveying roller pairs 506 and 507. The inlet motor M1, buffer motor M2, and sheet discharge motor M3 are stepping motors. The speeds of the motors M1, M2, and M3 are changed during the course of conveyance of sheets concurrently nipped between the roller pairs or between the roller and the pressing rollers driven by the motors M1, M2, and M3. The motor speeds are controlled in synchronization.

The flow of sheets in the finisher 500 in each of non-sorting mode, staple-sorting mode, and sorting mode will be described below.

Figure 10:
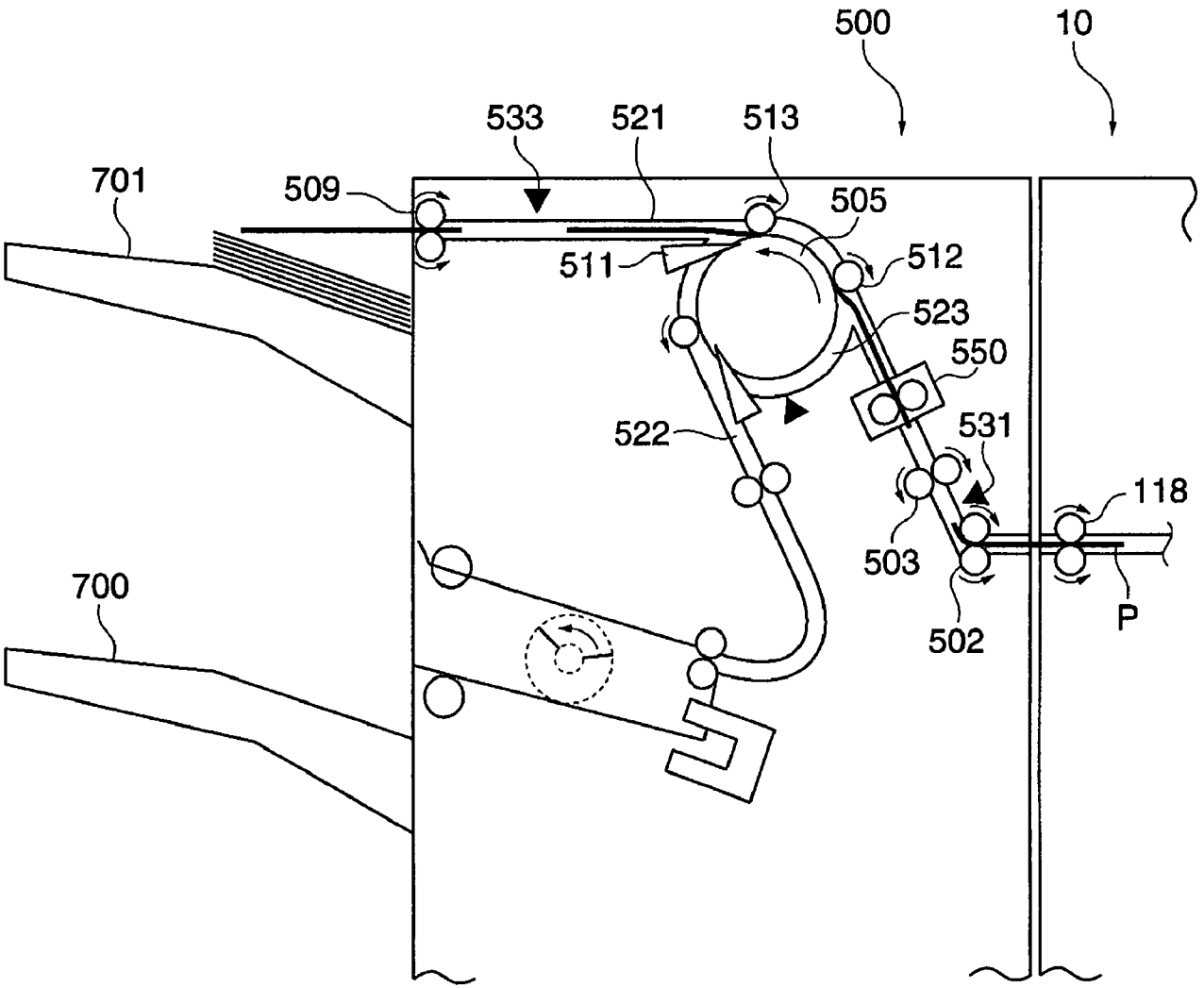
FIG. 10 is a cross-sectional view of a finisher, showing a flow of sheets in the finisher in a non-sorting mode.

FIG. 10 is a cross-sectional view of the finisher 500 showing a flow of sheets in the finisher 500 in the non-sorting mode.

When a user sets the non-sorting mode as the sheet discharge mode on the image forming apparatus main unit 10, as shown in FIG. 10, the inlet roller pair 502, the conveying roller pair 503, and the buffer roller 505 are driven to rotate and a sheet P discharged from the image forming apparatus main unit 10 is taken into the finisher 500 and conveyed therein. Here, the sheet P is discharged from the printer 300 to the finisher 500 at a process speed, which varies depending on sheet thickness as described above. In the finisher 500, the inlet roller pair 502 and the conveying roller pair 503 driven by the inlet motor M1 convey the sheet P initially at a slow speed conforming to the process speed of the printer 300. Then, at the timing the trailing end of the sheet P leaves the printer 300, the conveying speed of the roller pairs 502 and 503 is increased to, e.g., 500 mm/s. Then, after the trailing end of the sheet P leaves the conveying roller pair 503, the conveying speed of the inlet roller pair 502 and the conveying roller pair 503 is decreased to the process speed of the printer 300 at which the printer 300 performs processing on the next sheet, in order for the finisher 500 to receive the next sheet from the printer 300. The conveying speed of the rollers disposed at a location downstream of the conveying roller pair 503 is 500 mm/s, for instance.

The switching flapper 511 is driven to rotate to the position shown in FIG. 10 by a solenoid (not shown) and the sheet P is guided to the non-sorting path 521. When the discharge sensor 533 detects the trailing end of the sheet P, the discharge roller pair 509 thereafter rotates at a slower conveying speed of 400 mm/s suitable for stacking, thereby discharging the sheet P onto the sample tray 701. The speed reduction prevents the sheet P from running off the edge of the sample tray 701 and becoming out of alignment when the sheet P is discharged onto the sample tray 701.

Figure 11:
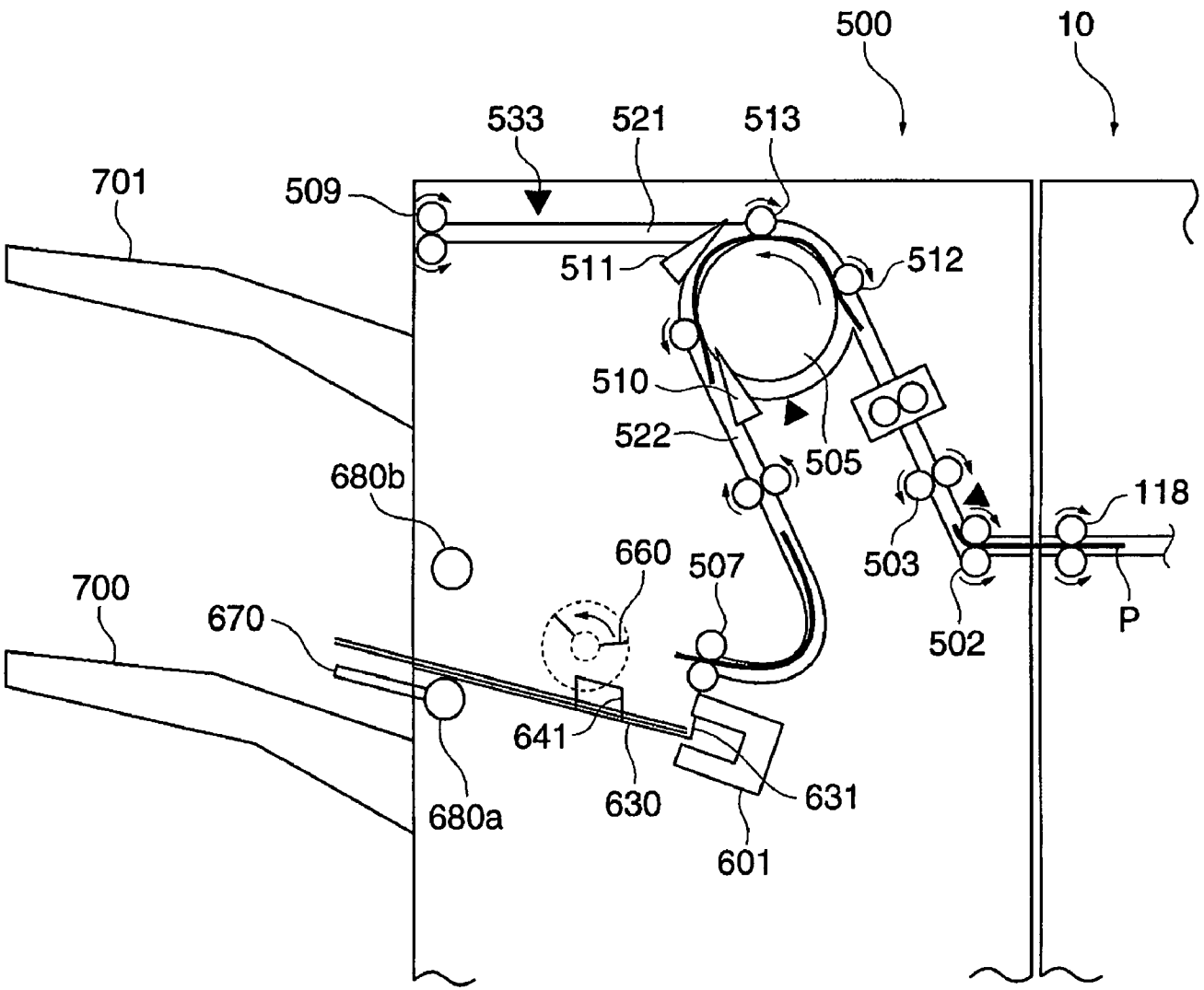
FIG. 11 is a cross-sectional view of the finisher, showing a flow of sheets in a sorting mode and a staple-sorting mode.

FIG. 11 is a cross-sectional view of the finisher 500 showing a flow of sheets in the sorting mode and the staple-sorting mode.

The difference between the sorting mode and the staple-sorting mode lies in whether stapling is performed or not on the processing tray 630. The flow of sheets before the sheets are discharged onto the processing tray 630 is the same both in the sorting mode and the staple-sorting mode.

When the sorting mode or the staple-sorting mode is set by a user, as shown in FIG. 11, the inlet roller pair 502, the conveying roller pair 503, and the buffer roller 505 are driven to rotate, so that a sheet P discharged from the image forming apparatus main unit 10 is taken into the finisher 500 and conveyed therein. The switching flappers 510 and 511 are at rest in the positions shown in FIG. 11 and therefore the sheet P is guided into the sorting path 522. The sheet P guided into the sorting path 522 is discharged by the conveying roller pair 507 to the processing tray 630. During the discharging, a retractable tray 670 projecting upward prevents sheet P discharged via the conveying roller pair 507, from hanging downward or failing to return, and facilitates alignment of sheets on the processing tray 630.

The sheet P discharged onto the processing tray 630 starts moving on the processing tray 630 toward the stopper 631 due to its own weight. The movement of the sheet P is assisted by an assisting member, such as a paddle 660. When the trailing end of the sheet P is brought into contact with the stopper 631 and stopped, alignment of discharged sheets is performed by the aligning member 641 as described above. After a predetermined number of sheets P are aligned and stacked, the stapling process is carried out, followed by the bundle of sheets P being discharged onto the stack tray 700. Since the sheets are discharged from the image forming apparatus main unit 10 as stated above with the image-formed surface facing downward, the bundle of the predetermined number of aligned sheets P has a leading page placed at the bottom and a last page placed at the top, with its image-formed surface facing downward.

In the non-sorting mode, sheets are conveyed via the non-sorting path 521; in the sorting mode and the staple-sorting mode, sheets are conveyed via the conveying path disposed around the buffer roller 505 or the conveying path disposed at a location upstream of the conveying roller pair 507. When compared with the conveying path in the non-sorting mode, the conveying path in the sorting mode or the staple-sorting mode is considerably bent. Accordingly, heavier loads are applied to the buffer motor M2 driving the buffer roller 505 and the discharge motor M3 driving the conveying roller pair 507 while a thick paper sheet is conveyed. Because the buffer motor M2 and the discharge motor M3 are stepping motors, a heavy load can cause a loss of synchronization of the stepping motors. To prevent the loss of synchronization, the motor driving current supplied to these motors is set to a higher value for conveyance of thick sheets. In addition, the motor driving speed, that is, the sheet conveying speed for conveyance of thick sheets, is set to a lower value to increase the motor torque for the thick sheet conveyance to a value higher than that for the ordinary sheet conveyance.

More specifically, in the case of the sorting mode or the staple-sorting mode being set in the finisher 500, the inlet roller pair 502 and the conveying roller pair 503 driven by the inlet motor M1 convey a sheet P at a speed conforming to the process speed of the printer 300 as in the non-sorting mode. After the trailing end of the sheet P leaves the printer 300, the conveying roller pairs 502 and 503 are accelerated to a conveying speed suitable for the thickness of the sheet P discharged from the printer 300 into the finisher 500 and convey the sheet P into the sorting path 522. When, for example, the thickness of the sheet P is less than or equal to 200 g/m$^2$, the conveying speed is preferably set to 500 mm/s. When the thickness of the sheet P is greater than 200 g/m$^2$, the conveying speed is set to 350 mm/s, for example. Then, in either case, before the trailing end of the sheet P leaves the conveying roller pair 507 and is discharged onto the processing tray 630, the conveying speed of the conveying roller pair 507 is reduced to 400 mm/s. FIG. 12 is a diagram showing the relationship between sheet thickness and sheet conveying speed in the finisher 500.

Processing of a plurality of sheet bundles in the finisher 500 will be described below.

While a bundle sheet discharge operation of a sheet bundle onto the processing tray 630 is being carried out, no subsequent sheet can be discharged onto the processing tray 630. Therefore, the conveyance of a subsequent sheet onto the processing tray 630 must be delayed. However, a delay in discharging a sheet from the printer 300 into the finisher 500 would reduce the productivity of the printer 300. In the present embodiment, in order to prevent a reduction in the productivity of the printer 300, the conveyance of subsequent sheets onto the processing tray 630 is caused to be delayed without delaying the sheet discharge from the printer 300 to the finisher 500.

Figure 13:
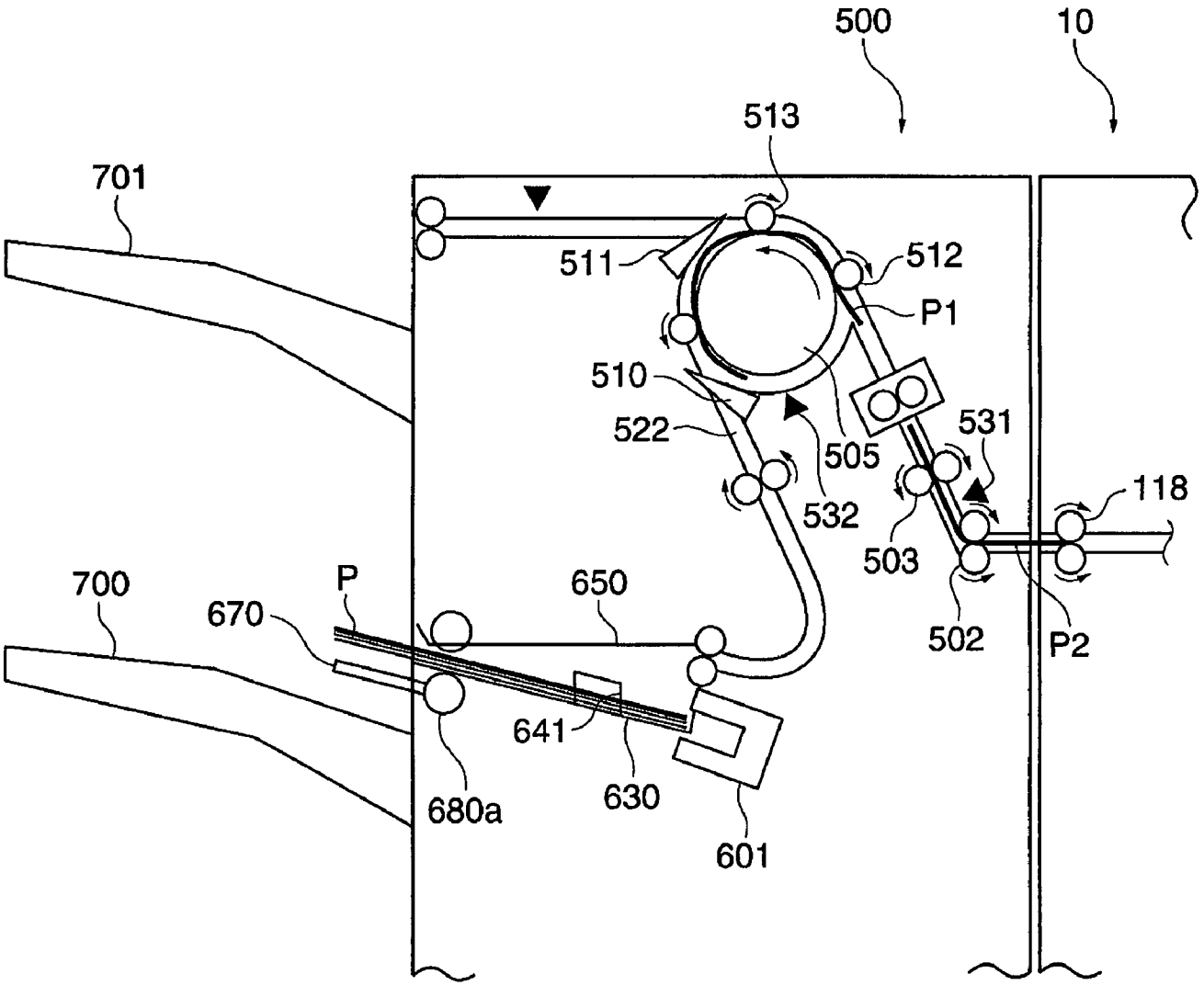
FIG. 13 is a cross-sectional view of the finisher, showing a first discharging process for discharging a plurality of sheet bundles in the finisher.

More specifically, while a bundle sheet discharge operation of a current sheet bundle onto the processing tray 630 is being carried out, the leading page P1 of the next sheet bundle discharged from the image forming apparatus main unit 10 is wound around the rotating buffer roller 505 by operation of the switching flapper 510 as shown in FIG. 13. After the start of winding of the leading page P1, the buffer roller 505 is stopped rotating when the front end of the leading page P1 is conveyed a predetermined distance from the buffer path sensor 532.

Figure 14:
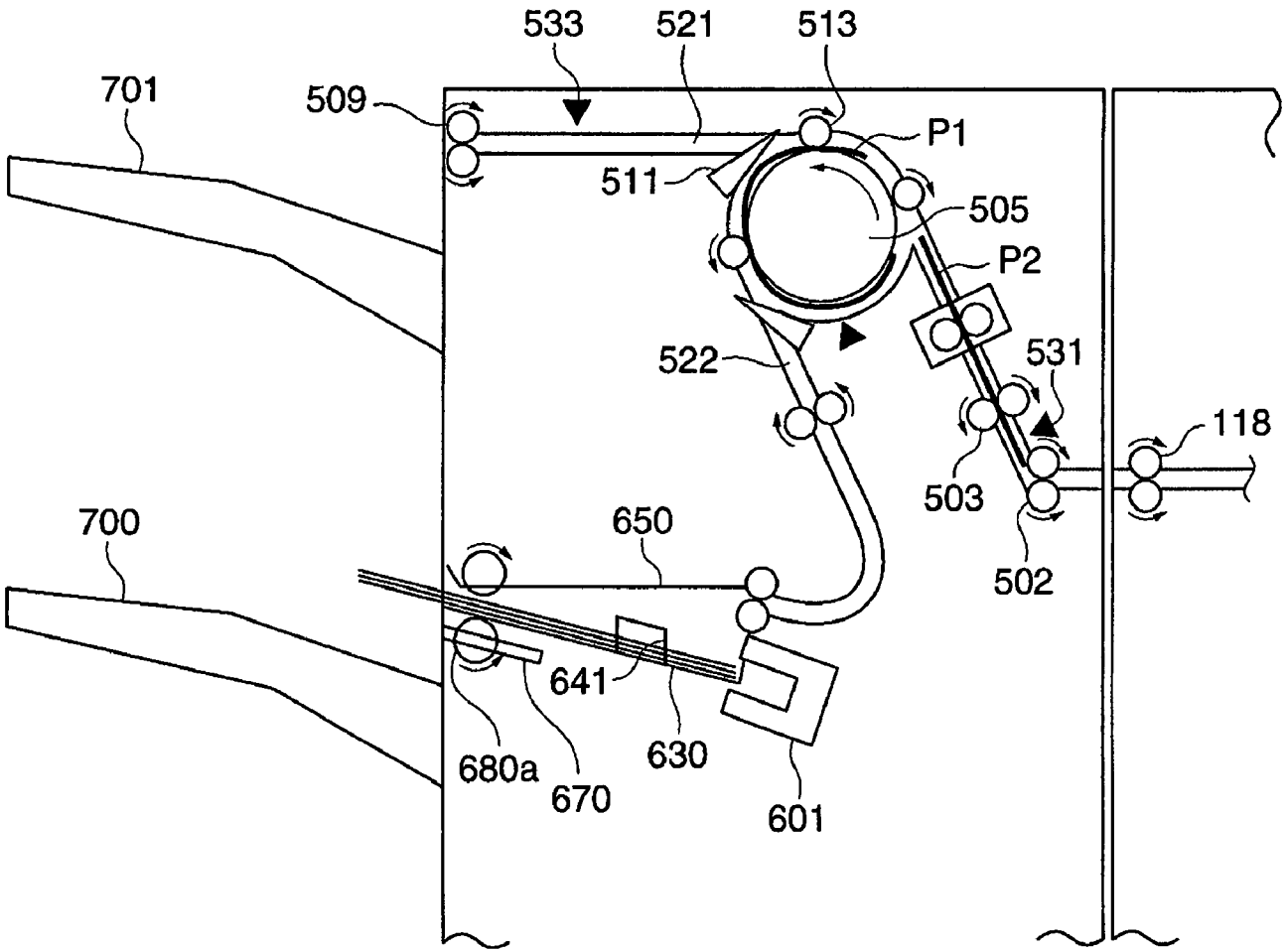
FIG. 14 is a cross-sectional view of the finisher, showing a second discharging process for discharging the sheet bundles in the finisher.
Figure 15:
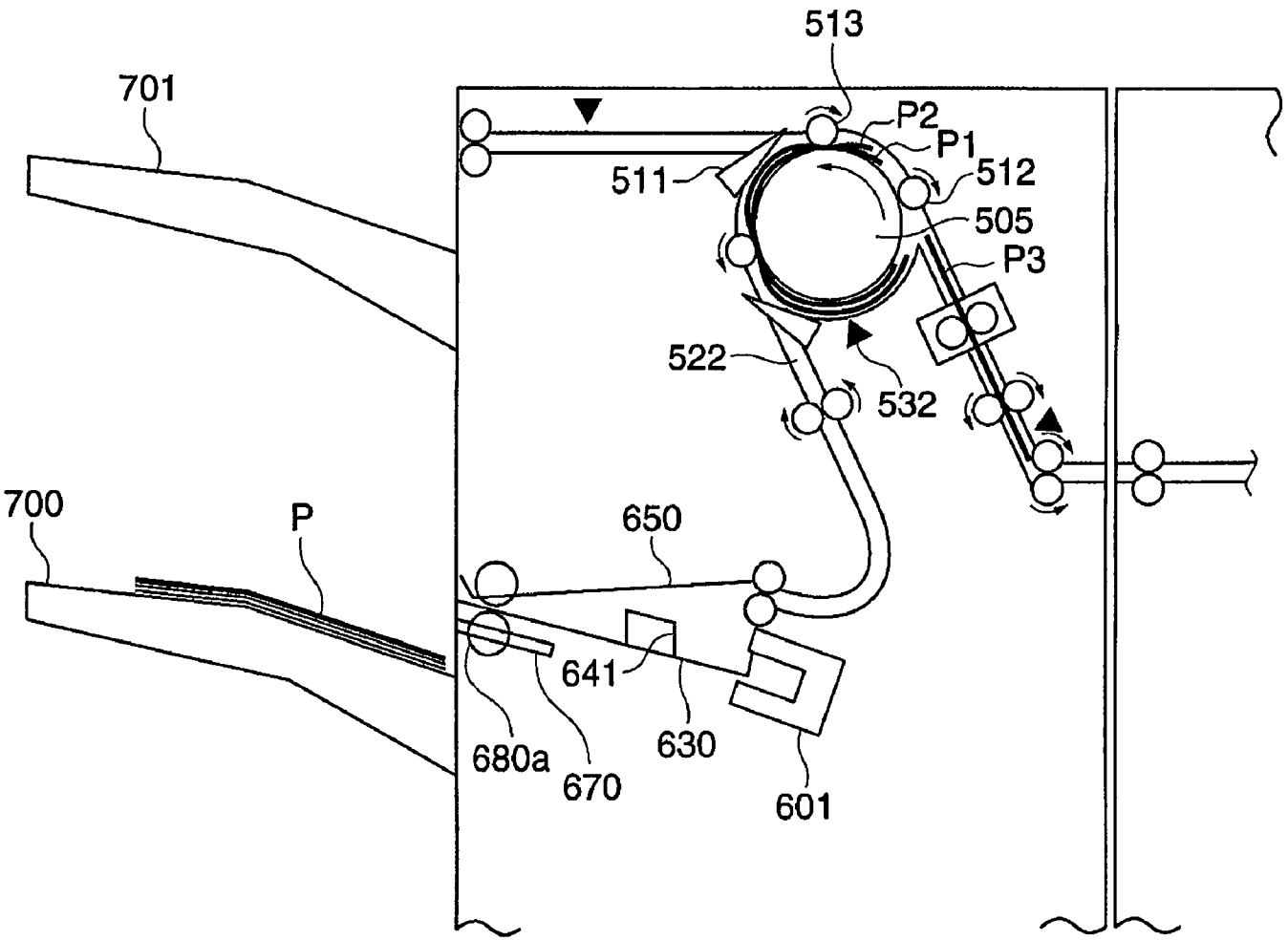
FIG. 15 is a cross-sectional view of the finisher, showing a third discharging process for discharging the sheet bundles in the finisher.

After the front end of the next page P2 of the next sheet bundle travels a predetermined distance from the inlet sensor 531 as shown in FIG. 14, the buffer roller 505 resumes rotating. As a result, the next page P2 overlaps the leading page P1 in such a manner that the trailing end of the sheet P2 is a predetermined distance ahead of that of the leading page P1 as shown in FIG. 15.

Figure 16:
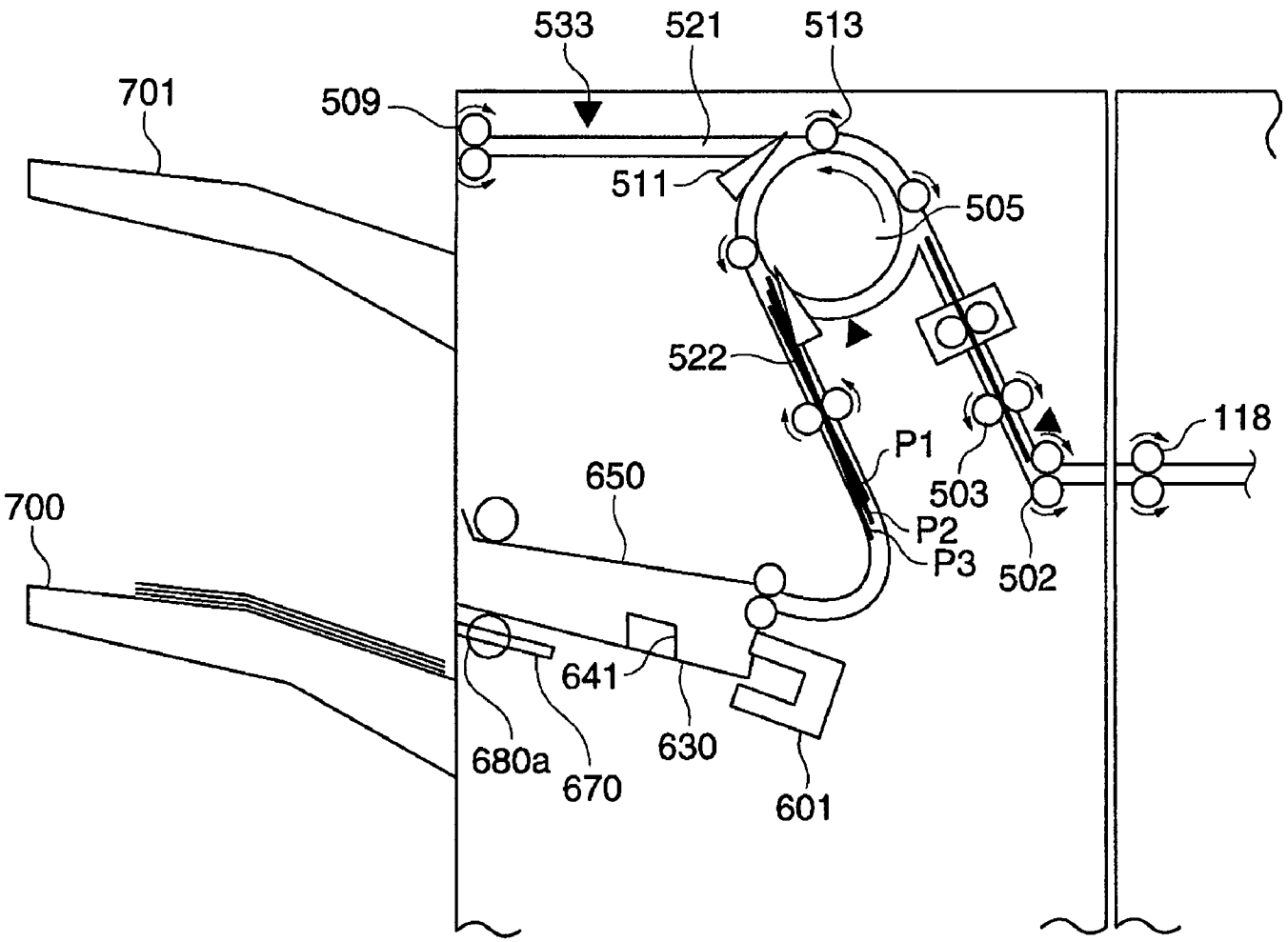
FIG. 16 is a cross-sectional view of the finisher, showing a fourth discharging process for discharging the sheet bundles in the finisher.

After the current sheet bundle is discharged from the processing tray 630 onto the stack tray 700, the pages P1 and P2 wound around the buffer roller 505 overlap a subsequent page P3 as shown in FIG. 16. Then, the pages P1, P2, and P3 are peeled off the buffer roller 505 by the switching flapper 511 and conveyed into the sorting path 522 as the next sheet bundle.

FIGS. 13 to 16 are cross-sectional views showing the four steps of the bundle sheet discharge process in the finisher 500 for discharging a plurality of sheet bundles in sequence.

The same process is repeated for the subsequent sheet bundles and a predetermined number of copies of sheet bundles are stacked on the stack tray 700. The sheet bundles are stacked on the stack tray 700 in a state where they are alternately offset from one another as shown in FIG. 9. Each sheet bundle has the leading page placed at the bottom and the last page placed at the top, with its image-formed surface facing downward.

While the process for stacking sheet bundles each consisting of three sheets has been described in the present embodiment, the sheet bundle may consist of any other number of sheets.

A method for setting the type of sheets contained in cassettes 120*a*-120*d* disposed in the lower part of the printer 300 will be described with reference to FIGS. 17 to 19.

To set the type of sheets contained in the cassettes 120*a*-120*d*, a user presses the user mode key 417 disposed on the operation display device 400 shown in FIG. 4, whereby a screen (not shown) for making various settings of the image forming apparatus is displayed on the display section 420. When a "sheet type registration" menu is selected in the screen, a screen as shown in FIG. 17 appears. FIG. 17 is a view showing an example of a screen for selection of sheet feed cassette displayed on the display section 420 of the operation display device 400.

Displayed in the screen are selection keys corresponding to sheet feed cassettes for each of which the type of sheets is to be set (in this embodiment, first to fourth selection keys individually corresponding to the cassettes 120*a* to 120*d*). In these selection keys, selection key numbers 1 to 4 and pieces of information about the size and type of sheets currently set for each cassette corresponding to each selection key are displayed. In the example shown in FIG. 17, these pieces of information indicate that the cassette 120*a* contains A4-size ordinary sheets, the cassette 120*b* contains B5-size color sheets, the cassette 120*c* contains B4-size ordinary sheets, and the cassettes 120*d* contains A3-size recycled sheets.

Figure 17:
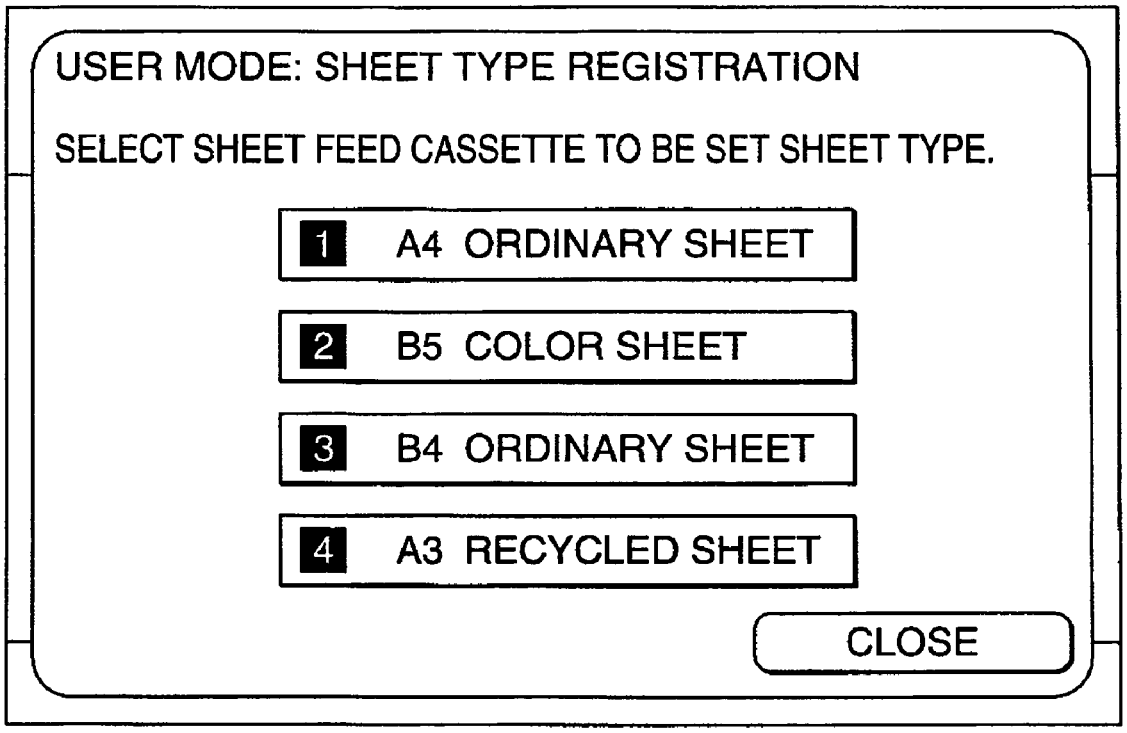
FIG. 17 is a view showing an example of a screen for selection of sheet feed cassette displayed on the display section of the operation display device.
Figure 18:
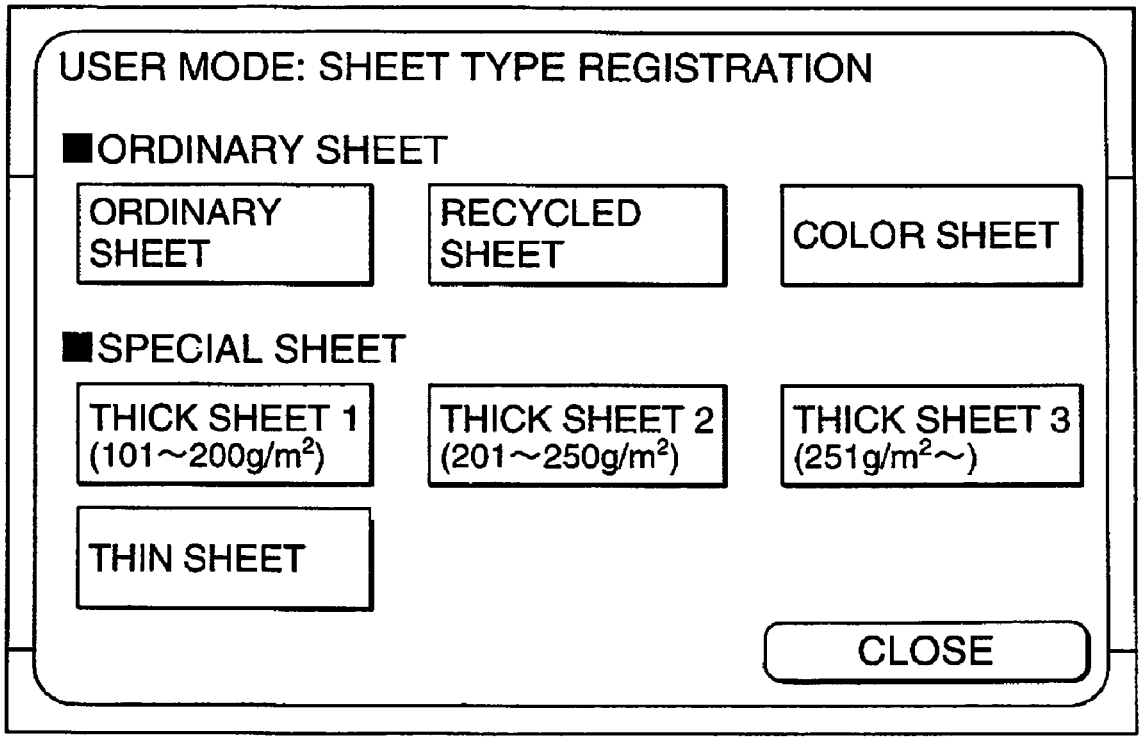
FIG. 18 is a view showing a sheet type selection screen displayed on the display section of the operation display device when the finisher is attached to the image forming apparatus main unit.

When any of the cassette selection keys in the screen shown in FIG. 17 is designated by a user's manual operation, a screen as shown in FIG. 18 appears. FIG. 18 is a view showing a sheet-type selection screen displayed on the display section 420 of the operation display device 400 when the finisher 500 is attached to the image forming apparatus main unit 10.

Displayed in this screen are keys for setting the type of sheet by selecting a desired sheet material from among such as ordinary sheet, recycled sheet, and color sheet and keys for setting the type of sheet by selecting a desired sheet thickness from among thin sheet and thick sheet. In the present embodiment, there are three types of sheets thicker than 100 g/m$^2$ that can be set as thick sheet. When any of the keys is selectively operated by the user in accordance with the type of sheets to be contained in the cassette, the setting of the sheet type for the cassette will be completed.

In the example shown in FIG. 18, thick sheets are classified into three types in terms of sheet thickness (basis weight). More specifically, sheets with a thickness ranging from 101 to 200 g/m$^2$ are classified as a first type of thick sheet (Thick sheet 1), sheets with a thickness ranging from 201 to 250 g/m$^2$ are classified as a second type of thick sheet (Thick sheet 2), and sheets with a thickness more than or equal to 251 g/m$^2$ are classified as a third type of thick sheet (Thick sheet 3). These three sheet thickness ranges are determined in consideration of the manner of setting the process speed in the printer 300 such that the process speed is lowered for thick sheets with a sheet thickness ranging from 101 g/m$^2$ to 250 g/m$^2$ and much lowered for thick sheets with a sheet thickness of 251 g/m$^2$ or more (FIG. 2) and the manner of setting the sheet conveying speed in the finisher 500 such that the conveying speed is lowered for thick sheets with a sheet thickness of 201 g/m$^2$ or more (FIG. 12).

It should be noted that when the finisher 500 is not attached to the image forming apparatus main unit 10, it is unnecessary to set one or more thickness ranges of thick sheet in consideration of the sheet conveying speed setting in the finisher 500. In such cases, it is enough to set two thick-sheet defining ranges in consideration of the process speed setting in the printer 300, and accordingly two thick sheet setting keys, one for a first thick sheet (101-250 g/m$^2$) and another for a second thick sheet (251 g/m$^2$ or more), are displayed as shown in FIG. 19. FIG. 19 is a view showing a sheet type selection screen displayed on the display section 420 of the operation display device 400 when the finisher 500 is not attached to the image forming apparatus main unit 10.

A method for determining three thick-sheet defining thickness ranges will be described below.

Sheet thickness data used for the printer 300 to change the process speed is stored in the ROM 151 of the CPU circuit section 150 in the controller shown in FIG. 3. The CPU circuit section 150 provides the data to the operation display device controller 401 to thereby enable the operation display device 400 to display thick sheet setting keys. On the other hand, sheet thickness data used for changing the conveying speed in the finisher 500 is sent from the finisher control section 501 to the CPU circuit section 150 of the controller of the printer 300 in response to a configuration request being sent from the CPU circuit section 150 to the finisher control section 501. The CPU circuit section 150 is connected with the finisher control section 501 so that serial communication therebetween can be carried out. Upon power-on of the system, initialization is performed between the CPU circuit section 150 and the finisher control section 501. When they become ready for communication, configuration information is exchanged between them.

Figure 20:
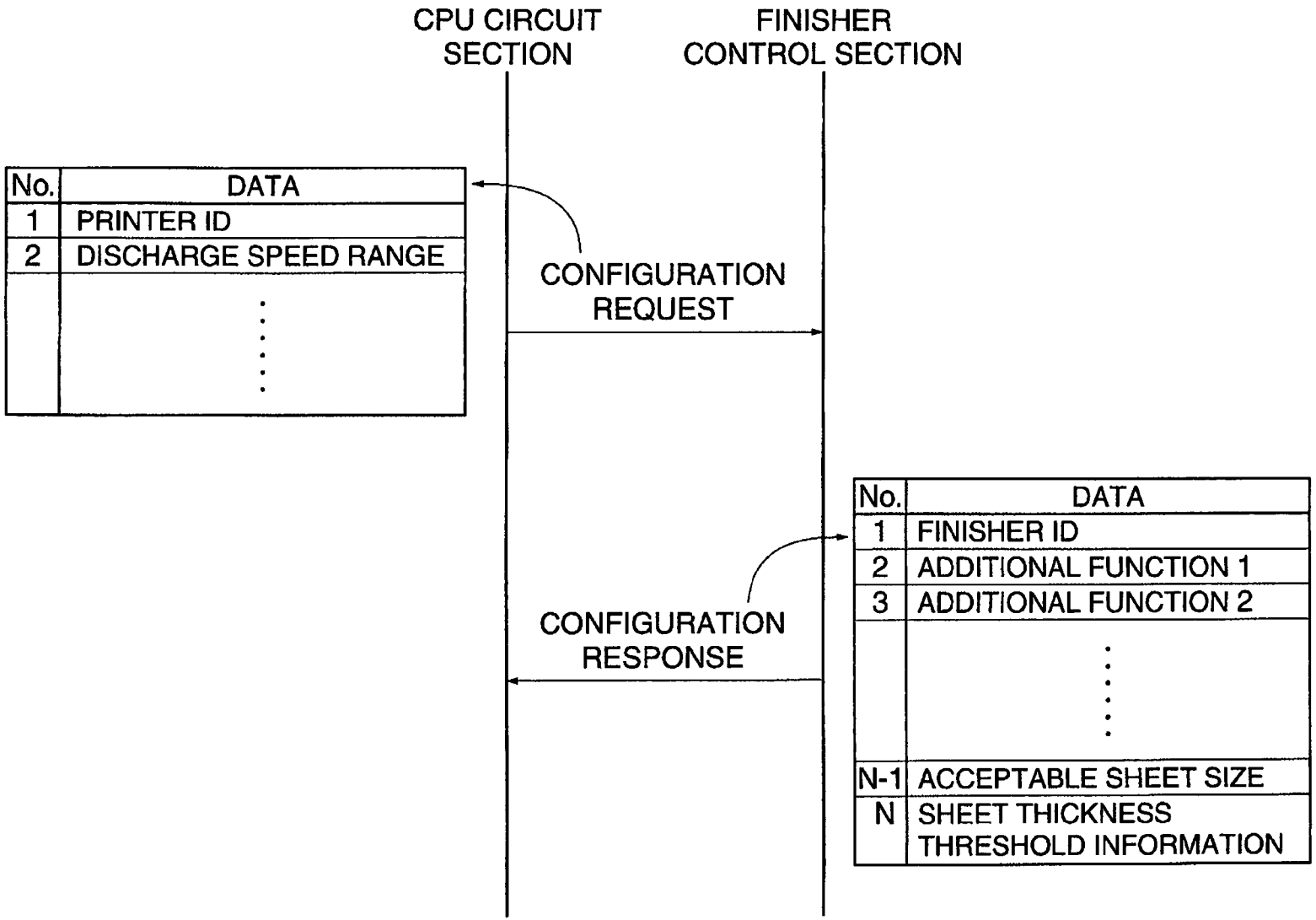
FIG. 20 is a sequence diagram illustrating transmission/reception of configuration information between a CPU circuit section of the controller and the finisher control section.

FIG. 20 is a sequence diagram illustrating transmission/reception of configuration information between the CPU circuit section 150 of the controller and the finisher control section 501.

First, the CPU circuit section 150 sends a configuration request to the finisher control section 501. Added to the configuration request is data such as a printer ID unique to the printer 300 and a range of speed at which the printer 300 discharges a sheet into the finisher 500. When the finisher 500 can alterably be attached to any one of a plurality of printers, a printer ID can be used to identify the printer to which the finisher 500 is attached and to change control accordingly.

When receiving the configuration request, the finisher control section 501 sends a configuration response to the CPU circuit section 150. Added to the configuration response is information such as a finisher ID unique to the finisher 500, additional function information indicating whether the finisher 500 has additional functions such as stapling and punching functions, acceptable sheet size information about acceptable sheet sizes the finisher 500 can receive from the printer 300, and sheet thickness threshold information indicating a threshold of sheet thickness which, when exceeded, causes the finisher 500 to change control in order to convey thick sheets. When the CPU circuit section 150 determines based on the additional function information that the finisher 500 does not have a stapling function, then the CPU circuit section 150 suppresses the display of a "Staple-sort" selection key on the menu selection screen shown in FIG. 6 to present a user an easy-to-use display. From the sheet thickness threshold information added to the configuration response, the CPU circuit section 150 obtains thickness data in accordance which the finisher 500 performs the variable control of sheet conveying speed.

The CPU circuit section 150 provides the information such as the additional function information and sheet thickness threshold information mentioned above to the operation display device controller 401 to cause the operation display device controller 401 to display the thick sheet setting keys shown in FIG. 18 on the display section 420 of the operation display device 400.

Alternatively, a sheet thickness threshold information table as shown in FIG. 21 may be stored beforehand in the ROM 151 of the CPU circuit section 150 of the controller, rather than adding the sheet thickness threshold information to the additional data added to a configuration response. FIG. 21 is a diagram showing a sheet thickness threshold information table containing the thickness thresholds for a plurality of finishers and stored in the ROM 151 of the CPU circuit section 150 of the controller.

The CPU circuit section 150 may refer to the sheet thickness threshold information table to retrieve a sheet thickness threshold associated with the finisher identified by the finisher ID added to a configuration response and may treat the retrieved sheet thickness threshold in the same manner as the sheet thickness threshold information added to the configuration response in the above-mentioned embodiment.

Figure 19:
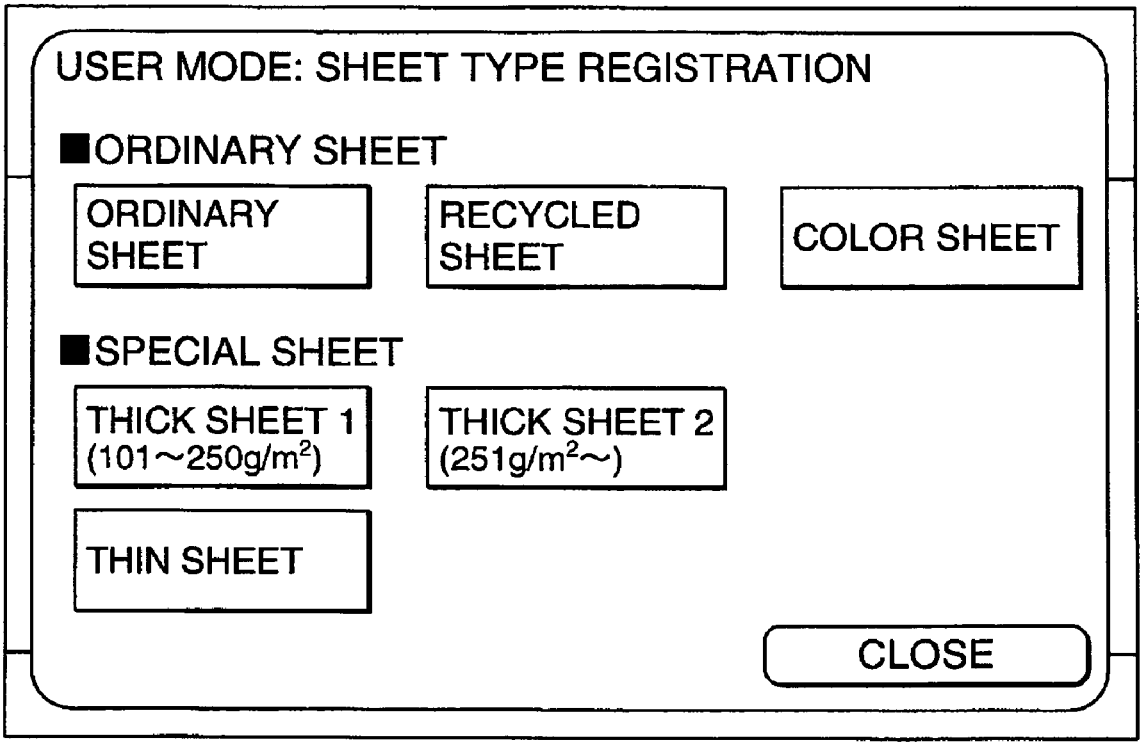
FIG. 19 is a view showing a sheet type selection screen displayed on the display section of the operation display device when the finisher is not attached to the image forming apparatus main unit.

A process for displaying thick sheet setting keys in a "Sheet type registration" screen as shown in FIG. 18 or 19 on the display section 420 of the operation display device 400 will be described with reference to FIG. 22.

Figure 22:
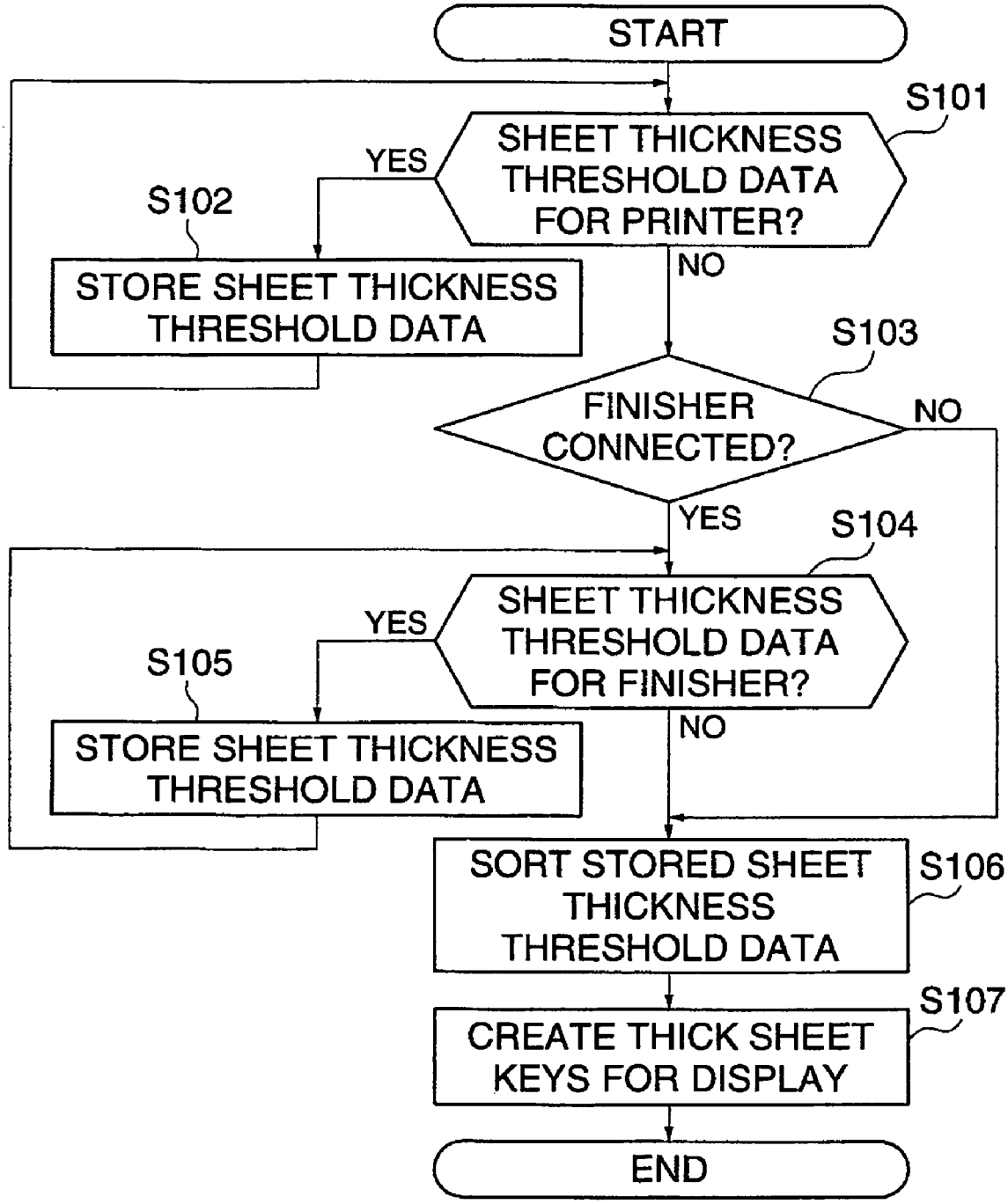
FIG. 22 is a flowchart illustrating a process for displaying thick sheet setting keys performed in the CPU circuit section of the controller and an operation display device controller.

FIG. 22 is a flowchart illustrating a process for displaying thick sheet setting keys performed in the CPU circuit section 150 of the controller and the operation display device controller 401.

First, the CPU circuit section 150 refers to data stored in the ROM 151 to determine whether there is any data that has not been read into the RAM 152 among the sheet thickness threshold data for the printer 300 (step S101). When there is such data, the process proceeds to step S102, where the data is read from the ROM 151 and stored in the RAM 152, then the process returns to step S101. On the other hand, when it is determined at step S101 that all the threshold data has been read from the ROM 151 to the RAM 152, or that there is no sheet thickness threshold data in the ROM 151, the process proceeds to step S103. In the present embodiment, step S102 is performed twice and two pieces of threshold data, 100 g/m$^2$ and 250 g/m$^2$ as shown in FIG. 2, are stored in the RAM 152.

At step S103, it is determined whether or not a finisher 500 is connected to the image forming apparatus main unit 10. The determination whether the finisher 500 is connected thereto is made based on whether communication is being performed between the CPU circuit section 150 and the finisher control section 501. When it is determined that the finisher 500 is connected to the image forming apparatus main unit 10, then the process proceeds to step S104; otherwise the process proceeds to step S106.

At step S104, the CPU circuit section 150 refers to information, which is added to the above-mentioned configuration response sent from the finisher 500, to determine whether among the sheet thickness threshold data there is any data that has not been read into the RAM 152. When it is determined that there is such data, the process proceeds to step S105, where the data is stored in the RAM 152 and then the process returns to step S104. On the other hand, at step S104, when it is determined at step S104 that all the sheet thickness threshold data has been stored in the RAM 152, or that the information sent from the finisher 500 does not include any sheet thickness threshold data, the process proceeds to step S106. In the present embodiment, step S105 is performed once and a single piece of threshold data, 200 g/m$^2$ as shown in FIG. 12, is stored in the RAM 152.

Figure 23:
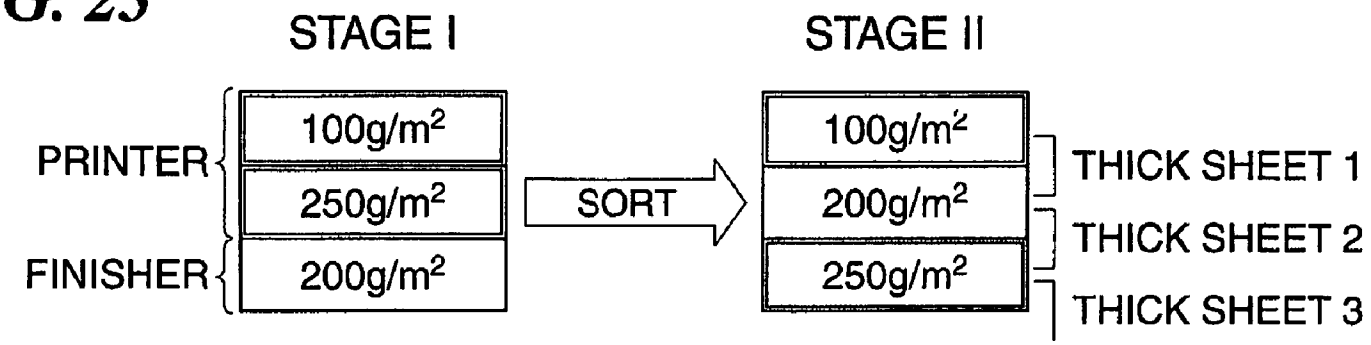
FIG. 23 is a view showing how pieces of sheet thickness threshold data stored in a RAM are sorted.

At step S106, pieces of sheet thickness threshold data for the printer 300 and the finisher 500 stored in the RAM 152 are sorted, as shown by stages I and II in FIG. 23, and the sorted data is delivered from the CPU circuit section 150 to the operation display device controller 401. FIG. 23 is a view showing how pieces of sheet thickness threshold data stored in the RAM 152 are sorted.

At step S107, the operation display device controller 401 creates thick sheet setting keys, "Thick sheet 1" to "Thick sheet N" keys, in the order in which the pieces of sheet thickness threshold data sent from the CPU circuit section 150 are sorted, and causes the thick sheet setting keys to be displayed on the display section 420 of the operation display device 400.

Figure 24:
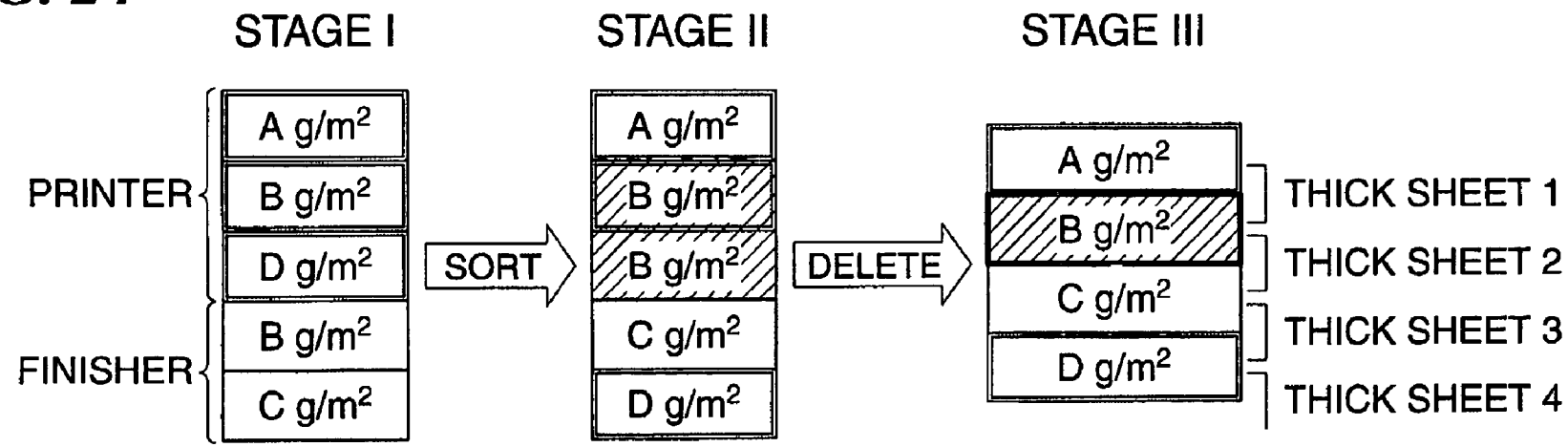
FIG. 24 is a view showing how pieces of sheet thickness threshold data stored in the RAM including duplicate sheet thickness threshold data are sorted.

When duplicate threshold data (shown by stage I in FIG. 24) are found as shown by stage II in FIG. 24 as a result of sorting of the threshold data at step S106, the CPU circuit section 150 deletes all the duplicate threshold data but one, as shown by stage III in FIG. 24, before delivering the one piece of threshold data to the operation display device controller 401. FIG. 24 is a view showing how pieces of sheet thickness threshold data stored in the RAM 152 including duplicate sheet thickness threshold data are sorted.

As has been described above, in the present embodiment, the post-processing apparatus can perform optimum control in accordance with sheet thickness.

It is to be understood that the object of the present invention may also be accomplished by supplying a system or an apparatus with a storage medium in which a program code of software that realizes the functions of any of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and the storage medium in which the program code is stored constitutes the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a non-volatile memory card, and a ROM. Alternatively the program code may be downloaded via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

In this case, the program code may be supplied directly from a storage medium on which the program code is stored, or from a computer, database, or the like, not shown, that is connected via the Internet, a commercial network, a local area network, or the like.

Although in the above described embodiment, the electrophotographic printing is adopted as the printing method executed by the image forming apparatus, there is no intention to limit the invention to this. For example, the present invention may be applied to a variety of printing methods such as ink-jet printing, thermal transfer, thermal printing, electrostatic printing, and discharge breakdown printing.

The form of the program may be an object code, a program code executed by an interpreter, or script data supplied to an OS (Operating System).

This application claims the benefit of Japanese Application No. 2005-071899, filed Mar. 14, 2005, which is hereby incorporated by reference herein in its entirety.

What is claimed is:

1. An image forming apparatus that is adapted for connection with a post-processing apparatus that post processes sheets and that controls a sheet conveying speed according to the sheet thickness, the image forming apparatus comprising:

a containing device configured to contain sheets;

a selecting device having a display device configured to display a plurality of candidates for sheet thicknesses and configured to permit a user to select a thickness of sheets contained in said containing device among the plurality of candidates for the sheet thicknesses;

an obtaining device configured to obtain first thickness-determination information used for controlling the sheet conveying speed in the post-processing apparatus from the post-processing apparatus and second thickness-determination information for controlling the sheet conveying speed in the image forming apparatus, each of the first thickness-determination information and the second thickness-determination information including threshold information for grouping the respective sheet thicknesses; and a determining device configured to determine a plurality of candidates for the sheet thicknesses to be displayed on said display device, based on the first thickness-determination information and the second thickness-determination information obtained by said obtaining device.

2. The image forming apparatus according to claim 1, further comprising:

a communication device configured to communicate with the post-processing apparatus, wherein said obtaining device obtains the first thickness-determination information from the post-processing apparatus via said communication device upon power being turned on.

3. An image forming apparatus that is adapted for connection with a post-processing apparatus that post processes sheets and that controls a sheet conveying speed according to the sheet thickness, the image forming apparatus comprising:

a containing device configured to contain sheets;

a selecting device having a display device configured to display a plurality of candidates for sheet thicknesses and configured to permit a user to select a thickness of sheets to be contained in said containing device among the plurality of candidates for the sheet thicknesses;

a storage device configured to store first thickness-determination information used for controlling the sheet conveying speed in the post-processing apparatus with respect to each type of a plurality of the post-processing apparatuses connectable to the image forming apparatus and second thickness-determination information for controlling the sheet conveying speed in the image forming apparatus, each of the first thickness-determination information and the second thickness-determination information including threshold information for grouping the respective sheet thicknesses; an identifying device configured to identify the type of the post-processing apparatus connected to the image forming apparatus; and a determining device configured to determine a plurality of candidates for the sheet thicknesses to be displayed on said display device, based on the first thickness-determination information corresponding to the type of the post-processing apparatus identified by said identifying device and the second thickness-determination information.

4. An image forming control method for an image forming apparatus that is adapted for connection with a post-processing apparatus that post processes sheets and that controls a sheet conveying speed according to the sheet thickness and has a containing device configured to contain sheets, and a selecting device having a display device configured to display a plurality of candidates for sheet thicknesses and configured to permit a user to select a thickness of sheets contained in said containing device among the plurality of candidates for the sheet thicknesses, the method comprising the steps of:

obtaining first thickness-determination information used for controlling the sheet conveying speed in the post-processing apparatus from the post-processing apparatus and second thickness-determination information for controlling the sheet conveying speed in the image forming apparatus, each of the first thickness-determination information and the second thickness-determination information including threshold information for grouping the respective sheet thicknesses; and determining a plurality of candidates for the sheet thicknesses to be displayed on the display device, based on the first thickness-determination information and the second thickness-determination information obtained in said obtaining step.

5. An image forming control method for an image forming apparatus that is adapted for connection with a post-processing apparatus that post processes sheets and that controls a sheet conveying speed according to the sheet thickness and has a containing device configured to contain sheets, and a selecting device having a display device configured to display a plurality of candidates for sheet thicknesses and configured to permit a user to select a thickness of sheets to be contained in said containing device among the plurality of candidates for the sheet thicknesses, the method comprising the steps of:

storing in a storage device first thickness-determination information used for controlling the sheet conveying speed in the post-processing apparatus with respect to each type of a plurality of the post-processing apparatuses connectable to the image forming apparatus and second thickness-determination information for controlling the sheet conveying speed in the image forming apparatus, each of the first thickness-determination information and the second thickness-determination information including threshold information for grouping the respective sheet thicknesses;

identifying the type of the post-processing apparatus connected to the image forming apparatus; and determining a plurality of candidates for the sheet thicknesses to be displayed on the display device, based on the first thickness-determination information corresponding to the type of the post-processing apparatus identified in the identifying step and the second thickness-determination information.

6. A non-transitory computer-readable medium storing a computer program for causing a computer to perform an image forming control method for an image forming apparatus that is adapted for connection with a post-processing apparatus that post processes sheets and that controls a sheet conveying speed according to the sheet thickness and has a containing device configured to contain sheets, and a selecting device having a display device configured to display a plurality of candidates for sheet thicknesses and configured to permit a user to select a thickness of sheets contained in said containing device among the plurality of candidates for the sheet thicknesses, the method comprising the steps of:

obtaining first thickness-determination information used for controlling the sheet conveying speed in the post-processing apparatus from the post-processing apparatus and second thickness-determination information for controlling the sheet conveying speed in the image forming apparatus, each of the first thickness-determination information and the second thickness-determination information including threshold information for grouping the respective sheet thicknesses; and determining a plurality of candidates for the sheet thicknesses to be displayed on the display device, based on the first thickness-determination information and the second thickness-determination information obtained in said obtaining step.

7. A non-transitory computer-readable medium storing a computer program for causing a computer to perform an image forming control method for an image forming apparatus that is adapted for connection with a post-processing apparatus that post processes sheets and that controls a sheet conveying speed according to the sheet thickness and has a containing device configured to contain sheets, and a selecting device having a display device configured to display a plurality of candidates for sheet thicknesses and configured to permit a user to select a thickness of sheets to be contained in said containing device among the plurality of candidates for the sheet thicknesses, the method comprising the steps of:

storing in a storage device first thickness-determination information used for controlling the sheet conveying speed in the post-processing apparatus with respect to each type of a plurality of the post-processing apparatuses connectable to the image forming apparatus and second thickness-determination information for controlling the sheet conveying speed in the image forming apparatus, each of the first thickness-determination information and the second thickness-determination information including threshold information for grouping the respective sheet thicknesses; and for grouping the respective sheet thicknesses; identifying the type of post-processing apparatus connected to the image forming apparatus; and determining a plurality of candidates for the sheet thicknesses to be displayed on the display device, based on the first thickness-determination information corresponding to the type of the post-processing apparatus identified in the identifying step and the second thickness-determination information.

8. An image forming apparatus that controls an image-forming operation according to a sheet thickness and that is connected to a post-processing apparatus that post processes sheets and that controls a sheet post-processing operation according to the sheet thickness, the image forming apparatus comprising:

a containing device configured to contain sheets;

an obtaining device configured to obtain first thickness-threshold information used for controlling the sheet conveying speed in the post-processing apparatus from the post-processing apparatus and second thickness-threshold information for controlling the sheet conveying speed in the image forming apparatus; and a determining device configured to determine a threshold for grouping the sheet thicknesses of the sheets contained in said containing device based on the first thickness-threshold information and the second thickness-threshold information obtained by said obtaining device.

9. The image forming apparatus according to claim 8, further comprising a display device configured to display the grouping of the sheet thicknesses of the sheets contained in said containing device based on the threshold determined by said determining device.

10. The image forming apparatus according to claim 8, wherein the grouping of the sheet thicknesses is represented by weight per unit area.

* * * * *